US006329131B1

(12) United States Patent
Morimura

(10) Patent No.: US 6,329,131 B1
(45) **Date of Patent: *Dec. 11, 2001**

(54) SILVER HALIDE EMULSION AND SILVER HALIDE PHOTOGRAPHIC LIGHT-SENSITIVE MATERIAL CONTAINING THE SAME

(75) Inventor: Kimiyasu Morimura, Minami-Ashigara (JP)

(73) Assignee: Fuji Photo Film Co., Ltd., Kanagawa (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/045,821

(22) Filed: Mar. 23, 1998

(30) Foreign Application Priority Data

Mar. 25, 1997 (JP) ..... 9-088714

(51) Int. Cl.[7] ..... G03C 1/09
(52) U.S. Cl. ..... 430/567; 430/569

(58) Field of Search ..... 430/567, 569

(56) References Cited

U.S. PATENT DOCUMENTS

| | | | | |
|---|---|---|---|---|
| 4,490,458 | * | 12/1984 | House | 430/569 |
| 4,672,027 | | 6/1987 | Daubendiek et al. | 430/567 |
| 4,748,106 | | 5/1988 | Hayashi | 430/567 |
| 5,244,781 | * | 9/1993 | Takada | 430/567 |
| 5,320,937 | * | 6/1994 | Ihama | 430/567 |
| 6,048,681 | * | 4/2000 | Suzimoto et al. | 430/567 |

* cited by examiner

*Primary Examiner*—Janet Baxter
*Assistant Examiner*—Amanda C. Walker
(74) *Attorney, Agent, or Firm*—Birch, Stewart, Kolasch & Birch, LLP

(57) ABSTRACT

In a silver halide emulsion, a sum of projected areas of tabular silver halide grains, in which an outer shell region which is 40% in volume from a grain surface contains 5 mol % to 20 mol % of iodide ions with respect to a silver halide in the outer shell region, and which have a projected area diameter of 0.08 $\mu$m to 0.5 $\mu$m and an aspect ratio of 2 to 30, accounts for 80% or more of the total projected area of all grains.

19 Claims, No Drawings

SILVER HALIDE EMULSION AND SILVER HALIDE PHOTOGRAPHIC LIGHT-SENSITIVE MATERIAL CONTAINING THE SAME

BACKGROUND OF THE INVENTION

The present invention relates to a silver halide emulsion and, more particularly, to a tabular silver halide emulsion which contains iodide ions at a high concentration in an outer peripheral portion of a grain and has an average projected area diameter of 0.08 μm to 0.5 μm and an aspect ratio of 2 to 30.

The roughness (graininess) of images of color photographic light-sensitive materials, particularly, color reversal photographic light-sensitive materials often used by professional photographers is especially conspicuous in a bright portion (highlight portion) of an image. This portion is formed by relatively small silver halide emulsion grains contained in the lowest-speed one of sensitive layers of each color. To improve the graininess brought about by a silver halide emulsion containing grains in a small-size region, it is necessary to minimize the silver halide grain size required to obtain the same sensitivity. That is, a sensitivity increasing technique which compensates for a decrease in the sensitivity caused by a decrease in the grain size is necessary. U.S. Pat. Nos. (to be also referred to as US hereinafter) 4,434,226, 4,439,520, 4,414,310, 4,433,048, 4,414,306, and 4,459,353 have disclosed a sensitivity increasing technique which improves the color sensitization ratio by spectral sensitizing dyes by increasing the surface of a grain for receiving light by using a tabular silver halide grain. U.S. Pat. Nos. 4,672,027 and 4,693,964 have disclosed tabular grains having an aspect ratio of 8 or more and an average diameter of 0.2 to 0.55 μm. Jpn. Pat. Appln. KOKAI Publication No. (hereinafter referred to as JP-A-)62-18555 has disclosed that a photographic light-sensitive material that is excellent in sharpness can be obtained by an emulsion containing silver halide grains having a thickness of less than 0.12 μm, an average diameter of less than 0.6 μm, and an aspect ratio of 5 or more. The present inventors have studied grains having an average projected area diameter in the range of 0.5 μm or less and an aspect ratio of 2 or more and confirmed that as the aspect ratio is increased, it is possible to use a larger amount of sensitizing dyes and raise the spectral sensitivity. On the other hand, it is found that the graininess deteriorates as the aspect ratio is increased, and as a consequence the total performance (sensitivity/graininess ratio) cannot be improved. Accordingly, a technique which improves the sensitivity/graininess ratio of tabular silver halide grains in a small-size region has been desired.

BRIEF SUMMARY OF THE INVENTION

It is an object of the present invention to find a technique which increases the sensitivity without causing the drawback that the graininess deteriorates when the aspect ratio is raised in a tabular silver halide whose average projected area diameter is 0.5 μm or less and aspect ratio is 2 or more, and provide a silver halide photographic emulsion with a high sensitivity/graininess ratio and a silver halide photographic light-sensitive material containing the emulsion.

DETAILED DESCRIPTION OF THE INVENTION

The present inventors have made extensive studies to obtain a tabular photographic emulsion having a high sensitivity/graininess ratio, an average projected area diameter of 0.5 μm or less, and an aspect ratio of 2 or more. Consequently, it is found that when the grain thickness of a tabular grain is decreased by increasing the aspect ratio, the grain becomes easier to dissolve in the grain preparation step or the development step, especially when a developer contains a solvent, and this strongly correlates with deterioration of the graininess. To raise the sensitivity without deteriorating the graininess, it is only necessary to form a grain composition and a grain structure by which a grain itself is hard to dissolve, and it turns out that it is extremely effective to make the surface region of a grain contain iodide at a high concentration. It is surprising that this effect is notable when the average projected area diameter of grains is 0.5 μm or less. Also, the method is very effective when the average grain thickness is 0.2 μm or less, particularly, 0.1 μm or less. It is also found that to increase the sensitivity in this grain structure, it is effective to form an epitaxial portion containing silver chloride, form a reduction-sensitized region, and use one or both of selenium sensitization and tellurium sensitization.

The present invention provides a silver halide photographic emulsion described below.

(1) A silver halide emulsion, wherein a sum of projected areas of tabular silver halide grains, in which an outer shell region that is 40% in volume from a grain surface contains 5 mol % to 20 mol % of iodide ions with respect to a silver halide in the outer shell region, and which have a projected area diameter of 0.08 μm to 0.5 μm and an aspect ratio of 2 to 30, accounts for 80% or more of the total projected area of all grains.

(2) The silver halide emulsion described in item (1), wherein assuming each tabular silver halide grain described in item (1) as a host grain and at least one epitaxially grown portion containing 10 mol % or more of silver chloride is further formed on the host grain.

(3) The silver halide emulsion described in item (1) above, wherein one or both of an interior and a surface of the tabular silver halide grain have at least one reduction-sensitized region.

(4) The silver halide emulsion described in item (1) above, wherein either a surface of the tabular silver halide grain or both an interior and a surface of the tabular silver halide grain are subjected to selenium sensitization, tellurium sensitization, or selenium-tellurium sensitization.

(5) The silver halide emulsion described in item (1) above, wherein either one or both of an interior and a surface of the tabular silver halide grain are subjected to reduction sensitization and selenium sensitization, reduction sensitization and tellurium sensitization, or reduction sensitization and selenium-tellurium sensitization.

(6) The silver halide emulsion described in any one of items (1), (2), (3), (4), and (5) above, wherein an average grain thickness of the tabular silver halide grains is 0.2 μm or less.

(7) A silver halide photographic light-sensitive material containing the silver halide emulsion described in item (1) above in at least one layer thereof.

The present invention will be described in detail below.

The halogen composition of the emulsion grain is preferably silver iodobromide or silver bromochloroiodide. Silver iodobromochloride containing 40 mol % or less of silver iodide is more preferable.

In the emulsion of the present invention, the sum of the projected areas of the tabular grains having a projected area diameter of 0.08 μm to 0.5 μm and an aspect ratio of 2 to 30 accounts for 80% or more of the total projected area of all grains. The production suitability of the emulsion is lowered if the projected area diameter of the grains is less than 0.08 μm or the aspect ratio exceeds 30. Most preferably, the sum of the projected areas of tabular grains having a projected area diameter of 0.08 μm to 0.4 μm and an aspect ratio of 3 to 25 accounts for 80% or more of the total projected area of all grains.

The projected area and the aspect ratio of a tabular grain can be measured from an electron micrograph shadowed together with a reference latex sphere by a carbon replica method. That is, the projected area diameter is represented by the diameter of a circle having the same area as the projected area. The major surface of the tabular grain commonly has a hexagonal, triangular, or circular shape when viewed in a direction perpendicular to the major surfaces, to be described below in detail. The aspect ratio is a value obtained by dividing the projected area diameter by the thickness. The higher the degree of a hexagon as the shape of the major surfaces of a tabular grain, the more preferable the tabular grain is. Also, the ratio of the lengths of adjacent sides of a hexagon is preferably 1:2 or less.

In the specification, the average grain thickness of grains means the average value of thickness of at least 100 grains in a homogeneous emulsion.

The effect of the present invention is enhanced as the aspect ratio is raised. Therefore, it is more preferable that 50% or more of the total projected area of the tabular grain emulsion is occupied by grains having an aspect ratio of 5 or more. Most preferably, grains having an aspect ratio of 8 or more account for 50% or more of the total projected area. However, if the aspect ratio becomes too high, the variation coefficient of a grain size distribution increases. Accordingly, it is usually preferable that grains having an aspect ratio of 25 or less account for 50% or more of the total projected area.

A tabular grain emulsion preferable in the present invention includes opposing (111) major surfaces and side surfaces connecting these major surfaces. At least one twin plane is present between the major surfaces. In the tabular grain emulsion of the present invention, two twin planes are usually observed. As described in U.S. Pat. No. 5,219,720, the spacing between these two twin planes can be decreased to less than 0.012 μm. Also, as described in JP-A-5-249585, a value obtained by dividing the distance between the (111) major surfaces by the twin plane spacing can be increased to 15 or more.

A silver iodobromide or bromochloroiodide tabular grain emulsion preferable in the present invention can be prepared by various methods. Generally, the preparation of a tabular grain emulsion basically includes three steps of nucleation, ripening, and growth.

In the nucleation step of a tabular grain emulsion preferable in the present invention, it is very effective to use gelatin with a small methionine content as described in U.S. Pat. No. 4,713,320 and U.S. Pat. No. 4,942,120, the disclosure of which are herein incorporated by reference, perform nucleation at a high pBr as described in U.S. Pat. No. 4,914,014, the disclosure of which is herein incorporated by reference, and perform nucleation within a short time period as described in JP-A-2-222940, the disclosure of which is herein incorporated by reference.

In the ripening step of a host tabular grain emulsion of the present invention, it is sometimes effective to perform the ripening in the presence of a low-concentration base as described in U.S. Pat. No. 5,254,453, the disclosure of which is herein incorporated by reference, or at a high pH as described in U.S. Pat. No. 5,013,641, the disclosure of which is herein incorporated by reference.

In the growth step of emulsion grains of the present invention, it is particularly effective to perform the growth at a low temperature as described in U.S. Pat. No. 5,248,587 or use fine silver iodide grains as described in U.S. Pat. No. 4,672,027 and U.S. Pat. No. 4,693,964, the disclosure of which are herein incorporated by reference.

Silver halide grains of the emulsion of the present invention are characterized in that the sum of the projected areas of grains, in which an outer shell region that is 40% or less in volume from the grain surface contains 5 mol % to 20 mol % of iodide ions with respect to the silver halide in the outer shell region, accounts for 80% or more of the total projected area of all grains. Hereinafter the outer shell region that is 40% or less in volume from the grain surface is also referred to as an "outer shell region (40). Preferably, the sum of the projected area of grains, in which another outer shell region that is 20% or less in volume from the grain surface contains 7 mol % to 15 mol % of iodide ions with respect to a silver halide in the outer shell region, accounts for 80% or more of the sum of the projected areas of all grains. Hereinafter the outer shell region that is 20% or less in volume from the grain surface is also referred to as an "outer shell region (20).

The "outer shell region" is a region which is different in formulated halogen composition from a region, i.e., an inner shell region, existing before the formation of the outer shell region, and is a region closest to the grain surface. The boundary of silver iodide containing layers between structures can be either a clear boundary or a continuously gradually changing boundary. Iodide ions can be added in the middle of the growth step so that the iodide content is uniform after that. However, the iodide ion concentration can be initially high and then become lower, can be initially low and then become higher, or can change during the processing. Iodide ions can be introduced by adding a KBr solution containing iodide ions and a $AgNO_3$ solution simultaneously or separately. It is also possible to add only a solution containing iodide ions under a condition by which iodide ions are incorporated into grains. Iodide ions can also be introduced by fine AgI grains.

Dislocation lines can be formed on the major surfaces or a peripheral portion (to be also referred to as a "fringe portion" hereinafter) of a grain by the introduction of iodide. It is preferable that dislocation lines be formed in the fringe portion, and it is most preferable that the density of these dislocation lines be high.

Dislocation lines in a tabular grain can be observed by a direct method described in, e.g., J. F. Hamilton, Phot. Sci. Eng., 11, 57, (1967) or T. Shiozawa, J. Soc. Phot. Sci. Japan, 35, 213, (1972), which is performed at a low temperature by using a transmission electron microscope. That is, silver halide grains are carefully extracted from an emulsion so as not to produce a pressure capable of forming dislocation lines in the grains, and are placed on a mesh for electron microscopic observation. The sample is observed by a transmission method while being cooled to prevent damages (e.g., print out) caused by electron rays. In this method, as the thickness of a grain increases, it becomes more difficult to transmit electron rays through it. Therefore, grains can be observed more clearly by using an electron microscope of high voltage type (200 kV or higher for a grain having a thickness of 0.25 μm).

A photograph of grains obtained by this method shows the positions and the number of dislocation lines in each grain when the grain is viewed in a direction perpendicular to the major surfaces.

The average number of dislocation lines is preferably 10 or more, and more preferably 20 or more per grain. If dislocation lines are densely present or cross each other when observed, it is sometimes impossible to accurately count the number of dislocation lines per grain. Even in these situations, however, dislocation lines can be roughly counted to such an extent as in units of ten lines, i.e., 10 dislocation lines, 20 dislocation lines, 30 dislocation lines, and so on. Accordingly, these cases can be clearly distinguished from cases where only several dislocation lines are present. The average number of dislocation lines per grain is obtained as a number average by counting the dislocation lines of 100 grains or more.

The tabular grain can have dislocation lines nearly uniformly over the entire area of the fringe portion or in a local position of the fringe portion. That is, in the case of a hexagonal tabular silver halide grain, for example, dislocation lines can be limited only to the vicinities of the six apexes or to the vicinity of one of these apexes. Dislocation lines can also be restricted only to the sides except for the vicinities of the six apexes. Furthermore, dislocation lines can be restricted to any of the fringe portion, the major surfaces, and a local position, or can be formed in two or more of these portions. That is, dislocation lines can exist in the fringe portion and on the major surfaces at the same time.

It is particularly preferable that silver halide grains of the emulsion of the present invention be used as a host and at least one epitaxially grown portion containing silver chloride be formed on the host. The ratio of AgCl in the halogen composition of the epitaxially grown portion is preferably 10 mol % or less based on silver halides in the epitaxially grown portion. A halogen composition in the expitaxially grown portion except for AgCl can be any of AgBr, AgI, and AgBrI, and preferably AgBrI. The amount of the epitaxially grown portion is 50 mol % or less, preferably 20 mol % or less of the silver amount of the host. The at least one epitaxially grown portion is not gathered at one place on the grain, but some epitaxially grown portions are deposited separately.

The epitaxial portion can be formed by adding a solution containing halogen ions and an $AgNO_3$ solution either simultaneously or separately. Alternatively, the epitaxial portion can be formed by adding AgCl, AgBr, or AgI grains smaller than host tabular grains or adding AgCl, AgBr, or AgI grins in appropriate combination with their mixed-crystal grains by appropriately combining them.

The epitaxial portion can be formed on the major surfaces or in the fringe portion of a tabular grain, or in a corner where adjacent sides of the grain intersect. The fringe portion or the corner is more preferable than the major surfaces.

The formation position of the epitaxial portion can be restricted by allowing a tabular grain to adsorb a dye or some other adsorbate or adding various types of halogen ions prior to forming the epitaxial portion. The formation position can also be restricted by structure in an iodide concentration of a tabular grain. One of ordinary skill in the art can form the epitaxial portion at a desired potation of a grain. A grain prepared by forming an epitaxial portion containing silver chloride around an emulsion grain in which dislocation lines are formed is most preferable among other grains of the present invention because this grain has the advantages of both the epitaxial portion and the dislocation lines.

In a tabular grain of the present invention having an outer shell region containing iodide ions at a relatively high concentration, it is particularly effective that the interior of the grain, the surface of the grain, or both the interior and the surface of the grain contain a reduction-sensitized region. The reduction-sensitized region is preferably at the surface, more preferably at both the interior and the surface, and much more preferably at the interior. The grain surface herein is a region which is 10 Å from the interface between the surface of a silver halide grain and gelatin covering the grain, or the interface between the surface of a silver halide grain and an adsorbate to the grain. The interior herein is a region that positioned inside the grain surface. Note that an adsorbate indicates physical adsorption (to the grain surface) and does not include the epitaxially grown portion.

The reduction-sensitized region can be formed by any of a method of adding a reduction sensitizer to a silver halide emulsion, a method called silver ripening in which grains are grown or ripened in a low-pAg ambient at pAg 1 to 7, and a method called high-pH ripening in which grains are grown or ripened in a high-pH ambient at pH 8 to 11. Two or more of these methods can also be combined together.

The method of adding a reduction sensitizer is preferable in that the level of reduction sensitization can be finely adjusted.

Known examples of the reduction sensitizers are stannous chloride, ascorbic acid and its derivative, amines and polyamines, a hydrazine derivative, formamidinesulfinic acid, a silane compound, and a borane compound. In the reduction sensitization performed for the emulsion of the present invention, it is possible to selectively use one of these known reduction sensitizers or to use two or more different compounds together.

Compounds preferable as the reduction sensitizer are stannous chloride, thiourea dioxide, dimethylamineborane, and ascorbic acid and its derivative. Although the addition amount of the reduction sensitizers must be so selected as to meet the emulsion manufacturing conditions, a preferable amount is $10^{-7}$ to $10^{-3}$ mol per mol of the silver halides in the emulsion.

The reduction sensitizers are dissolved in water or a solvent, such as alcohols, glycols, ketones, esters, or amides, and the resultant solution is added during grain growth. Although adding to a reactor vessel in advance is also preferable, adding at a given timing during grain growth is more preferable. It is also possible to add the reduction sensitizers to an aqueous solution of a water-soluble silver salt or a water-soluble alkali halide to precipitate silver halide grains by using this aqueous solution. Alternatively, a solution of the reduction sensitizers can be added separately several times or continuously over a long time period with grain growth.

One chemical sensitization which can be preferably performed for the emulsion of the present invention is chalcogen sensitization, noble metal sensitization, or a combination of these. This sensitization can be performed by using active gelatin as described in T. H. James, The Theory of the Photographic Process, 4th ed., Macmillan, 1977, pages 67 to 76. The sensitization can also be performed by using any of sulfur, selenium, tellurium, gold, platinum, palladium, and iridium, or by using a combination of a plurality of these sensitizers at a pAg of 5 to 10, a pH of 5 to 8, and a temperature of 30 to 80° C., as described in Research Disclosure, Vol. 120, April, 1974, 12008, Research Disclosure, Vol. 34, June, 1975, 13452, U.S. Pat. Nos. 2,642,361, 3,297,446, 3,772,031, 3,857,711, 3,901,714, 4,266,018, and 3,904,415, and British Patent No. 1,315,755. In the noble metal sensitization, salts of noble metals, such as gold, platinum, palladium, and iridium, can be used. In particular, gold sensitization, palladium sensitization, or the combination of the both is preferable. In the gold sensitization, it is possible to use known compounds, such as chloroauric acid, potassium chloroaurate, potassium aurithiocyanate, gold sulfide, and gold selenide. A palladium compound means a divalent or tetravalent salt of palladium. A preferable palladium compound is represented by $R_2PdX_6$ or $R_2PdX_4$ wherein R represents a hydrogen atom, an alkali metal atom, or an ammonium group and X represents a halogen atom, i.e., a chlorine, bromine, or iodine atom.

More specifically, a palladium compound is preferably $K_2PdCl_4$, $(NH_4)_2PdCl_6$, $Na_2PdCl_4$, $(NH_4)_2PdCl_4$, $Li_2PdCl_4$, $Na_2PdCl_6$, or $K_2PdBr_4$. It is preferable that a gold compound and a palladium compound be used in combination with thiocyanate or selenocyanate.

Examples of a sulfur sensitizer are hypo, a thiourea-based compound, a rhodanine-based compound, and sulfur-containing compounds described in U.S. Pat. Nos. 3,857,711, 4,266,018, and 4,054,457. The chemical sensitization can also be performed in the presence of a so-called chemical sensitization aid. Examples of a useful chemical sensitization aid are compounds, such as azaindene, azapyridazine, and azapyrimidine, which are known as compounds capable of suppressing fog and increasing sensitivity in the process of chemical sensitization. Examples of the chemical sensitization aid modifier are described in U.S. Pat. Nos. 2,131,038, 3,411,914, and 3,554,757, JP-A-58-126526, and G. F. Duffin, "Photographic Emulsion Chemistry", pages 138 to 143.

It is particularly preferable that the surface of the tabular grain or both the interior and the surface of the tabular grain of the present invention be subjected to selenium sensitization, tellurium sensitization, or selenium-tellurium sensitization. The definitions of the surface and the interior of a grain are the same as described earlier with regard to the reduction sensitization.

Selenium sensitization means sensitization processing using at least one of the selenium sensitizers described below and also includes sensitization processing using at least one type of sulfur sensitizers and gold sensitizers in addition to the selenium sensitizer. Selenium sensitization is preferably performed together with gold sensitization and more preferably together with sulfur sensitization or both sulfur sensitization and gold sensitization.

Tellurium sensitization means sensitization processing using at least one of the tellurium sensitizers described below and also includes processing using at least one type of sulfur sensitizers and gold sensitizers in addition to the tellurium sensitizer. Tellurium sensitization is preferably performed together with gold sensitization and more preferably performed together with sulfur sensitization or both sulfur sensitization and gold sensitization.

Selenium-tellurium sensitization means sensitization processing using both at least one of the selenium sensitizers and at least one of the tellurium sensitizers described below and also includes processing using at least one type of sulfur sensitizers and gold sensitizers in addition to the selenium and tellurium sensitizer. Selenium-tellurium sensitization is preferably performed together with gold sensitization and more preferably performed together with sulfur sensitization or both sulfur sensitization and gold sensitization.

Labile selenium compounds can be used in selenium sensitization. Preferable compounds are described in, e.g., U.S. Pat. Nos. 3,297,446 and 3,297,447, JP-A-4-25832, JP-A-4-109240, JP-A-4-147250, JP-A-4-271341, JP-A-5-40324, JP-A-5-224332, JP-A-5-224333, JP-A-5-11385, JP-A-6-43576, JP-A-6-75328, JP-A-6-175258, JP-A-6-175259, JP-A-6-180478, JP-A-6-208184, and JP-A-6-208186.

Specific examples are phosphine selenides (e.g., triphenylphosphineselenide, diphenyl(pentafluorophenyl) phosphineselenide), selenophosphates (e.g., tri-p-tolylselenophosphate), selenophosphinic acid esters, selenophosphonic acid esters, selenoureas (e.g., N,N-dimethylselenourea, N-acetyl-N,N',N'-trimethylselenourea, N-trifluoroacetyl-N,N',N'-trimethylselenourea), selenoamides (e.g., N,N-dimethylselenobenzamide, N,N-diethylselenobenzamide), selenoesters (e.g., p-methoxyselenobenzoic acid o-isopropylester, p-methoxyselenobenzoic acid Se-(3'-oxocyclohexyl)ester), diacylselenides (e.g., bis(2,6-dimethoxybenzoyl)selenide, bis(2,4-dimethoxybenzoyl)selenide), dicarbamoylselenides (e.g., bis(N,N-dimethylcarbamoyl)selenide), bis(alkoxycarbonyl)selenides (e.g., bis(n-butoxycarbonyl) selenide, bis(benzyloxycarbonyl)selenide), triselenanes (e.g., 2,4,6-tris(p-methoxyphenyl)triselenane), diselenides, polyselenides, seleniumsulfide, selenoketones, selenocarboxylic acids, isoselenocyanates, and colloidal selenium. Preferably, phosphineselenides, selenoamides, dicarbamoylselenides, bis(alkoxycarbonyl)selenides, and selenoesters are used.

Additionally, it is possible to use non-labile selenium compounds described in Jpn. Pat. Appln. KOKOKU Publication Nos. (hereinafter referred to as JP-B-)46-4553 and JP-B-52-34492, e.g., sodium selenite, potassium selenocyanate, selenazoles, and selenides.

The addition amount of selenium sensitizers is preferably $1\times10^{-4}$ to $1\times10^{-7}$ mol, and more preferably $1\times10^{-5}$ to $5\times10^{-7}$ mol per mol of the silver halides in the emulsion.

Labile tellurium compounds are used in tellurium sensitization. It is possible to use labile tellurium compounds described in, e.g., JP-A-4-224595, JP-A-4-271341, JP-A-4-333043, JP-A-5-303157, JP-A-6-27573, JP-A-6-175258, JP-A-6-180478, JP-A-6-208184, JP-A-6-208186, JP-A-6-317867, JP-A-7-140579, JP-A-7-301879, and JP-A-7-301880.

More specifically, it is possible to use phosphinetellurides (e.g., normalbutyl-diisopropylphosphinetelluride, triisobutylphosphinetelluride, trinormalbutoxyphosphinetelluride, triisopropylphosphinetelluride), diacyl(di)tellurides (e.g., bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethoxycarbonyl)telluride), telluroureas (e.g., N,N'-dimethylethylenetellurourea), telluroamides, and telluroesters. Preferable compounds are phosphinetellurides and diacyl(di)tellurides.

The addition amount of tellurium sensitizers is preferably $1\times10^{-4}$ to $1\times10^{-7}$ mol, and more preferably $1\times10^{-5}$ to $5\times10^{-7}$ mol per mol of the silver halides in the emulsion.

Emulsions of the present invention are preferably also subjected to gold sensitization. The amount of gold sensitizers is preferably $1\times10^{-4}$ to $1\times10^{-7}$ mol, and more preferably $1\times10^{-5}$ to $5\times10^{-7}$ per mol of silver halides in the emulsion.

A preferable range of a palladium compound is $1\times10^{-3}$ to $5\times10^{-7}$ mol per mol of the silver halides in the emulsion.

A preferable range of a thiocyan compound or a selenocyan compound is $5\times10^{-2}$ to $1\times10^{-6}$ mol per mol of the silver halides in the emulsion.

The amount of sulfur sensitizers used in silver halide grains of the present invention is preferably $1\times10^{-4}$ to $1\times10^{-7}$ mol, and more preferably $1\times10^{-5}$ to $5\times10^{-7}$ mol per mol of the silver halides in the emulsion.

It is advantageous to use gelatin as a protective colloid for use in the preparation of emulsions of the present invention or as a binder for other hydrophilic colloid layers. However, another hydrophilic colloid can also be used in place of gelatin.

Examples of the hydrophilic colloid are protein, such as a gelatin derivative, a graft polymer of gelatin and another high polymer, albumin, and casein; a sugar derivative, such as hydroxyethylcellulose, carboxymethylcellulose, a cellulose derivative such as cellulose sulfates, soda alginate, and a starch derivative; and a variety of synthetic hydrophilic high polymers, such as homopolymers or copolymers, e.g., polyvinyl alcohol, polyvinyl alcohol partial acetal, poly-N-vinylpyrrolidone, polyacrylic acid, polymethacrylic acid, polyacrylamide, polyvinylimidazole, and polyvinylpyrazole.

Examples of gelatin are lime-processed gelatin, acid-processed gelatin, and enzyme-processed gelatin described in Bull. Soc. Sci. Photo. Japan. No. 16, page 30 (1966). It is also possible to use gelatin processed by phthalic acid described in JP-A-8-82883. In addition, a hydrolyzed product or an enzyme-decomposed product of gelatin can be used.

It is preferable to wash an emulsion of the present invention for a desalting purpose to form a newly prepared protective colloid dispersion. Although the temperature of washing can be selected in accordance with the intended use, it is preferably 5° C. to 50° C. Although the pH of washing can also be selected in accordance with the intended use, it is preferably 2 to 10, and more preferably 3 to 8. The pAg of washing is preferably 5 to 10, though it can also be selected in accordance with the intended use. The washing method can be selected from noodle washing, dialysis using a semipermeable membrane, centrifugal separation, coagulation precipitation, and ion exchange. The coagulation precipitation can be selected from a method using sulfate, a method using an organic solvent, a method using a water-soluble polymer, and a method using a gelatin derivative.

It is sometimes useful to perform a method of adding a chalcogen compound during preparation of an emulsion, such as described in U.S. Pat. No. 3,772,031. In addition to S, Se, and Te, cyanate, thiocyanate, selenocyanic acid, carbonate, phosphate, and acetate can be present.

It is preferable to use an oxidizer for silver during the process of manufacturing emulsions of the present invention. The oxidizer for silver means a compound having an effect of converting metal silver into silver ion. A particularly effective compound is the one that converts very fine silver grains, which arise as a by-product in the process of formation of silver halide grains and chemical sensitization, into silver ion. The silver ion produced can form a silver salt hard to dissolve in water, such as a silver halide, silver sulfide, or silver selenide, or a silver salt easy to dissolve in water, such as silver nitrate. The oxidizer for silver can be either an inorganic or organic substance. Examples of the inorganic oxidizer are ozone, hydrogen peroxide and its adduct (e.g., $NaBO_2 . H_2O_2 . 3H_2O$, $2NaCO_3 . 3H_2O_2$, $Na_4P_2O_7 . 2H_2O_2$, and $2Na_2SO_4 . H_2O_2 . 2H_2O$), peroxy acid salt (e.g., $K_2S_2O_8$, $K_2C_2O_6$, and $K_2P_2O_8$), a peroxy complex compound (e.g., $K_2[Ti(O_2)C_2O_4] . 3H_2O$, $4K_2SO_4 . Ti(O_2)OH . SO_4 . 2H_2O$, and $Na_3[VO(O_2)(C_2H_4)_2] . 6H_2O$), permanganate (e.g., $KMnO_4$), an oxyacid salt such as chromate (e.g., $K_2Cr_2O_7$), a halogen element such as iodine and bromine, perhalogenate (e.g., potassium periodate), a salt of a high-valence metal (e.g., potassium hexacyanoferrate(II)), and thiosulfonate. Examples of the organic oxidizer are quinones such as p-quinone, an organic peroxide such as peracetic acid and perbenzoic acid, and a compound which releases active halogen (e.g., N-bromosuccinimide, chloramine T, and chloramine B).

Preferable oxidizers usable in the present invention are ozone, hydrogen peroxide and its adduct, a halogen element, and thiosulfonate as inorganic oxidizers, and quinones as organic oxidizers. It is preferable to use both the reduction sensitization described above and the oxidizer for silver. In this case, the reduction sensitization can be performed after the oxidizer is used or vice versa, or the reduction sensitization and the use of the oxidizer can be performed at the same time. These methods can be performed during the step of grain formation or after the step of grain formation.

The emulsion of the present invention can be any of a surface latent image type emulsion which primarily forms a latent image on the surface of a grain, an internal latent image type emulsion which forms a latent image in the interior of a grain, and an emulsion which forms a latent image both on the surface and in the interior of a grain. However, an emulsion must be a negative type emulsion. The internal latent image type emulsion can also be a core/shell internal latent image type emulsion described in JP-A-63-264740. A method of preparing this core/shell internal latent image type emulsion is described in JP-A-59-133542. Although the thickness of the shell of this emulsion depends upon, e.g., the development processing, it is preferably 3 to 40 nm, and most preferably 5 to 20 nm.

The photographic emulsions of the present invention can contain various compounds in order to prevent fog during the manufacturing process, storage, or photographic processing of a sensitive material, or to stabilize photographic properties. Usable compounds are those known as an antifoggant or a stabilizer, for example, thiazoles, such as benzothiazolium salt, nitroimidazoles, nitrobenzimidazoles, chlorobenzimidazoles, bromobenzimidazoles, mercaptothiazoles, mercaptobenzothiazoles, mecaptobenzimidazoles, mercaptothiadiazoles, aminotriazoles, benzotriazoles, nitrobenzotriazoles, and mercaptotetrazoles (particularly 1-phenyl-5-mercaptotetrazole); mercaptopyrimidines; mercaptotriazines; a thioketo compound such as oxadolinethione; and azaindenes such as triazaindenes, tetrazaindenes (particularly 4-hydroxy-substituted(1,3,3a,7) tetrazaindenes), and pentazaindenes. For example, compounds described in U.S. Pat. Nos. 3,954,474 and 3,982,947 and JP-B-52-28660 can be used. One preferable compound is described in U.S. Pat. No. 4,952,490. Antifoggants and stabilizers can be added at any of several different timings, such as before, during, and after grain formation, during washing with water, during dispersion after the washing, before, during, and after chemical sensitization, and before coating, in accordance with the intended object. The antifoggants and the stabilizers can be added during preparation of an emulsion to achieve their original fog preventing effect and stabilizing effect. In addition, the antifoggants and the stabilizers can be used for various purposes of, e.g., controlling crystal habit of grains, decreasing a grain size, decreasing the solubility of grains, controlling chemical sensitization, and controlling an arrangement of dyes.

The photographic emulsions of the present invention are preferably subjected to spectral sensitization by methine dyes and the like in order to achieve the effects of the present invention. Usable dyes involve a cyanine dye, a merocyanine dye, a composite cyanine dye, a composite merocyanine dye, a holopolar cyanine dye, a hemicyanine dye, a styryl dye, and a hemioxonole dye. Most useful dyes are those belonging to a cyanine dye, a merocyanine dye, and a composite merocyanine dye. Any nucleus commonly used as a basic heterocyclic nucleus in cyanine dyes can be applied to these dyes. Examples of an applicable nucleus are a pyrroline nucleus, an oxazoline nucleus, a thiozoline nucleus, a pyrrole nucleus, an oxazole nucleus, a thiazole nucleus, a selenazole nucleus, an imidazole nucleus, a tetrazole nucleus, and a pyridine nucleus; a nucleus in which an aliphatic hydrocarbon ring is fused to any of the above nuclei; and a nucleus in which an aromatic hydrocarbon ring is fused to any of the above nuclei, e.g., an indolenine nucleus, a benzindolenine nucleus, an indole nucleus, a benzoxadole nucleus, a naphthoxazole nucleus, a benzthiazole nucleus, a naphthothiazole nucleus, a benzoselenazole nucleus, a benzimidazole nucleus, and a quinoline nucleus. These nuclei can be substituted on a carbon atom.

It is possible to apply to a merocyanine dye or a composite merocyanine dye a 5- to 6-membered heterocyclic nucleus as a nucleus having a ketomethylene structure. Examples of the ketomethylene structure are a pyrazoline-5-one nucleus, a thiohydantoin nucleus, a 2-thiooxazolidine-2,4-dione nucleus, a thiazolidine-2,4-dione nucleus, a rhodanine nucleus, and a thiobarbituric acid nucleus.

Although these sensitizing dyes can be used singly, they can also be used together. The combination of sensitizing dyes is often used for a supersensitization purpose. Representative examples of the combination are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patent Nos. 1344281 and 1507803, JP-B-43-4936, JP-B-53-12375, JP-A-52-110618, and JP-A-52-109925, the disclosure of which are all incorporated herein by reference.

In addition to the sensitizing dyes, emulsions can contain at least one dye having no spectral sensitizing effect by itself or at least one substance not essentially absorbing visible light and presenting supersensitization.

The sensitizing dyes can be added to an emulsion at any point in preparation of an emulsion, which is conventionally known to be useful. Most ordinarily, the addition is performed after the completion of chemical sensitization and before coating. However, it is possible to perform the addition at the same timing as the addition of chemical sensitizing dyes to perform spectral sensitization and chemical sensitization simultaneously, as described in U.S. Pat. Nos. 3,628,969 and 4,225,666. It is also possible to perform the addition prior to chemical sensitization, as described in JP-A-58-113928, or before the completion of formation of a silver halide grain precipitation to start spectral sensitization. Alternatively, as disclosed in U.S. Pat. No. 4,225,666, these compounds can be added separately; i.e., a portion of the compounds can be added prior to chemical sensitization, while the remaining portion is added after that. That is, the compounds can be added at any timing during formation of silver halide grains, including a method disclosed in U.S. Pat. No. 4,183,756. Although the addition amount can be $4\times10^{-6}$ to $8\times10^{-3}$ mol per mol of the silver halides in the emulsion, an addition amount of $5\times10^{-5}$ to $5\times10^{-3}$ mol per mol of the silver halides in the emulsion is more effective.

In the silver halide photographic emulsions of the present invention and silver halide photographic light-sensitive materials using the emulsions, it is generally possible to use various techniques and add inorganic and organic materials described in Research Disclosure No. 308119 (1989) and No. 37038 (1995).

In the photographic material, the emulsion of the present invention are preferably added to at least one of the light sensitive emulsion layers, i.e., blue-, green-, and red-sensitive emulsion layers, and more preferably each of blue-, green-, and red-sensitive emulsion layers.

Additionally, techniques and inorganic and organic materials usable in color photographic light-sensitive materials to which silver halide photographic emulsions of the present invention can be applied are described in portions of EP (European Patent) 436938A2 and patents cited below.

| | |
|---|---|
| 1. Yellow couplers | page 137, line 35 to page 146, line 33, and page 149, lines 21 to 23 |
| 2. Magenta couplers | page 149, lines 24 to 28; EP 421453A1, page 3, line 5 to page 25, line 55 |
| 3. Cyan couplers | page 149, lines 29 to 33; EP 432804A2, page 3, line 28 to page 40, line 2 |
| 4. Polymer couplers | page 149, lines 34 to 38; EP 435334A2, page 113, line 39 to page 123, line 37 |
| 5. Colored couplers | page 53, line 42 to page 137, line 34, and page 149, lines 39 to 45 |
| 6. Other functional couplers | page 7, line 1 to page 53, line 41, and page 149, line 46 to page 150, line 3; EP 435334A2, page 3, line 1 to page 29, line 50 |
| 7. Antiseptic and mildew proofing agents | page 150, lines 25 to 28 |
| 8. Formalin scavengers | page 149, lines 15 to 17 |
| 9. Other additives | page 153, lines 38 to 47; EP 421453A1, page 75, line 21 to page 84, line 56, and page 27, line 40 to page 37, line 40 |
| 10. Dispersion methods | page 150, lines 4 to 24 |
| 11. Supports | page 150, lines 32 to 34 |
| 12. Thickness and physical properties of film | page 150, lines 35 to 49 |
| 13. Color development · black-and-white development · fogging process | page 150, line 50 to page 151, line 47; EP 442323A2, page 34, lines 11 to 54, and page 35, lines 14 to 22 |
| 14. Desilvering process | page 151, line 48 to page 152, line 53 |
| 15. Automatic developing machine | page 152, line 54 to page 153, line 2 |
| 16. Washing · stabilizing process | page 153, lines 3 to 37 |

The present invention will be described in more detail below by way of its examples, but the invention is not limited to these examples.

EXAMPLES

Example 1

Preparation of Emulsion Em-a An aqueous solution containing 64 g of KBr and 5.0 g of low-molecular-weight gelatin having an average molecular weight of 10,000 to 20,000 in 500 cc and an aqueous solution containing 90 g of silver nitrate and 4 g of ammonium nitrate in 500 cc were added at 35° C. over 30 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 215.7 g of KBr and 11.6 g of KI in 1 L and an aqueous solution containing 316 g of silver nitrate and 0.6 g of ammonium nitrate in 1 L were added over 28 min by a double-jet method. During the addition, the pAg was held at 8.5. In this addition (2), 94.3% of the total silver amount were consumed. Subsequently, the resultant emulsion was washed with water at 35° C. by a well-known flocculation method, gelatin was added, and the pH and the pAg were adjusted to 6.3 and 8.4, respectively, at 40° C. The result was a tabular AgBrI emulsion (I=3.5 mol %) Em-a having an average grain diameter of 0.23 μm as the diameter of a sphere having the same volume, an average projected area diameter of 0.32 μm, and an average aspect ratio of 4.5.

Preparation of Emulsion Em-b

Grains were prepared by separating solution addition step (2) in the preparation process of the emulsion Em-a into solution addition step (2) and solution addition step (3) as follows:

An aqueous solution containing 225 g of KBr in 1L and an aqueous solution containing 316 g of silver nitrate and 0.6 g of ammonium nitrate in 1 L were added over 13.5 min by a double-jet method. During the addition, the pAg was held at 8.5. In this addition (2), 24.3% of the total silver amount were consumed. Subsequently, an aqueous solution containing 212.8 g of KBr and 15.6 g of KI in 1 L and an aqueous solution containing 316 g of silver nitrate and 0.6 g of ammonium nitrate in 1 L were added over 15 min by a double-jet method. During the addition, the pAg was held at 8.5. In this addition (3), 70% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=3.5 mol %) Em-b having an average grain diameter of 0.23 μm as the diameter of a sphere having the same volume, an average projected area diameter of 0.31 μm, and an average aspect ratio of 4.4.

Preparation of Emulsion Em-c

Grains were prepared by changing solution addition step (2) and solution addition step (3) in the preparation process of the emulsion Em-b as follows:

An aqueous solution containing 225 g of KBr in 1 L and an aqueous solution containing 316 g of silver nitrate and 0.6 g of ammonium nitrate in 1 L were added over 20.5 min by a double-jet method. During the addition, the pAg was held at 8.5. In this addition (2), 52.3% of the total silver amount were consumed. Subsequently, an aqueous solution containing 205.0 g of KBr and 26.6 g of KI in 1 L and an aqueous solution containing 316 g of silver nitrate and 0.6 g of ammonium nitrate in 1 L were added over 7.8 min by a double-jet method. During the addition, the pAg was held at 8.5. In this addition (3), 42% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=3.5 mol %) Em-c having an average grain diameter of 0.23 μm as the diameter of a sphere having the same volume, an average projected area diameter of 0.31 μm, and an average aspect ratio of 4.5.

Preparation of Emulsion Em-d

Grains were prepared by changing solution addition step (2) and solution addition step (3) in the preparation process of the emulsion Em-b as follows:

An aqueous solution containing 225 g of KBr in 1 L and an aqueous solution containing 316 g of silver nitrate and 0.6 g of ammonium nitrate in 1 L were added over 22 min by a double-jet method. During the addition, the pAg was held at 8.5. In this addition (2), 59.4% of the total silver amount were consumed. Subsequently, an aqueous solution containing 201.6 g of KBr and 31.3 g of KI in 1 L and an aqueous solution containing 316 g of silver nitrate and 0.6 g of ammonium nitrate in 1 L were added over 6 min by a double-jet method. During the addition, the pAg was held at 8.5. In this addition (3), 35% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=3.5 mol %) Em-d having an average grain diameter of 0.23 μm as the diameter of a sphere having the same volume, an average projected area diameter of 0.31 μm, and an average aspect ratio of 4.4.

Preparation of Emulsion Em-e

Grains were prepared by changing solution addition step (2) and solution addition step (3) in the preparation process of the emulsion Em-b as follows:

An aqueous solution containing 225 g of KBr in 1 L and an aqueous solution containing 316 g of silver nitrate and 0.6 g of ammonium nitrate in 1 L were added over 25.5 min by a double-jet method. During the addition, the pAg was held at 8.5. In this addition (2), 76.9% of the total silver amount were consumed. Subsequently, an aqueous solution containing 179.2 g of KBr and 62.5 g of KI in 1 L and an aqueous solution containing 316 g of silver nitrate and 0.6 g of ammonium nitrate in iL were added over 3 min by a double-jet method. During the addition, the pAg was held at 8.5. In this addition (3), 17.5% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=3.5 mol %) Em-e having an average grain diameter of 0.23 μm as the diameter of a sphere having the same volume, an average projected area diameter of 0.31 μm, and an average aspect ratio of 4.5.

Preparation of Emulsion Em-f

Grains were prepared by changing solution addition step (2) and solution addition step (3) in the preparation process of the emulsion Em-b as follows:

An aqueous solution containing 225 g of KBr in 1 L and an aqueous solution containing 316 g of silver nitrate and 0.6 g of ammonium nitrate in 1 L were added over 21 min by a double-jet method. During the addition, the pAg was held at 8.5. In this addition (2), 54.3% of the total silver amount were consumed. Subsequently, an aqueous solution containing 159.1 g of KBr and 55.5 g of KI in 1 L and an aqueous solution containing 316 g of silver nitrate and 0.6 g of ammonium nitrate in 1 L were added over 7 min by a double-jet method. During the addition, the pAg was held at 8.5. In this addition (3), 40% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=8 mol %) Em-f having an average grain diameter of 0.23 μm as the diameter of a sphere having the same volume, an average projected area diameter of 0.31 μm, and an average aspect ratio of 4.5.

Preparation of Emulsion Em-g

Grains were prepared by changing solution addition step (2) and solution addition step (3) in the preparation process of the emulsion Em-b as follows:

An aqueous solution containing 225 g of KBr in 1 L and an aqueous solution containing 316 g of silver nitrate and 0.6 g of ammonium nitrate in 1 L were added over 21 min by a double-jet method. During the addition, the pAg was held at 8.5. In this addition (2), 54.3% of the total silver amount were consumed. Subsequently, an aqueous solution containing 153.5 g of KBr and 63.4 g of KI in 1 L and an aqueous solution containing 316 g of silver nitrate and 0.6 g of ammonium nitrate in 1 L were added over 7 min by a double-jet method. During the addition, the pAg was held at 8.5. In this addition (3), 40% of the total silver amount were consumed. The resultant emulsion was washed with water at 35° C. by a well-known flocculation method, gelatin was added, and the pH and the pAg were adjusted to 6.3 and 8.4, respectively, at 40° C. The result was a tabular AgBrI emulsion (average I=10 mol %) Em-g having an average grain diameter of 0.23 μm as the diameter of a sphere having the same volume, an average projected area diameter of 0.31 μm, and an average aspect ratio of 4.5.

Preparation of Emulsions Em-a' to Em-g'

Em-a' was prepared by optimally performing sulfur sensitization by using hypo after the preparation of the emulsion Em-a. Em-b' to Em-g' were similarly prepared from Em-b to Em-g, respectively.

Preparation of Emulsions Em-h, Em-i, and Em-j

Em-h was prepared following the same procedure as for the emulsion Em-a except that $3\times10^{-5}$ mol of thiourea dioxide was added as a reduction sensitizer per mol of silver contained in the completed grains after solution addition step (1) in the preparation process of Em-a. Em-i and Em-j were similarly prepared by performing reduction sensitization for Em-b and Em-d, respectively.

Preparation of Emulsions Em-k, Em-l, and Em-m

Em-k was prepared by optimally performing gold-sulfur-selenium sensitization by using potassium thiocyanate, hypo as a sulfur sensitizer, N,N-dimethylselenourea as a selenium sensitizer, and chloroauric acid as a gold sensitizer after the preparation of the emulsion Em-a. Em-l and Em-m were similarly prepared by optimally performing gold-sulfur-selenium sensitization after the preparation of Em-b and Em-d, respectively.

Preparation of Emulsions Em-n, Em-o, and Em-p

Em-n was prepared by optimally performing gold-sulfur-selenium-tellurium sensitization by using potassium thiocyanate, hypo as a sulfur sensitizer, N,N-dimethylselenourea as a selenium sensitizer, bis (diphenylcarbamoyl)ditelluride as a tellurium sensitizer, and chloroauric acid as a gold sensitizer after the preparation of the emulsion Em-h. Em-o, Em-p, Em-q, and Em-r were similarly prepared by optimally performing gold-sulfur-selenium-tellurium sensitization after the preparation of Em-i, Em-j, Em-f, and Em-g, respectively.

Preparation of Emulsions Em-q and Em-r

Em-q and Em-r were prepared by adding $3\times10^{-5}$ mol of thiourea dioxide as a reduction sensitizer per mol of silver of the completed grains after solution addition step (1) in the preparation processes of the emulsions Em-f and Em-g, respectively, and optimally performing gold-sulfur-selenium-tellurium sensitization after that.

Preparation of Emulsions Em-s, Em-t, Em-u, Em-v, Em-w, Em-x, and Em-y

Em-s, Em-t, Em-u, Em-v, Em-w, Em-x, and Em-y were prepared by preparing tabular AgBrI emulsions having the same halogen compositions as the emulsions Em-a, Em-b, Em-c, Em-d, Em-e, Em-f, and Em-g, respectively, and having an average grain diameter of 0.60 μm as the diameter of a sphere having the same volume, an average projected area diameter of 1.1 μm, and an average aspect ratio of 4.5, and optimally chemically sensitizing the resultant emulsions by using hypo.

Table 1 below shows the data of the emulsions Em-a' to Em-g', Em-h to Em-r, and Em-s to Em-y. The data includes the average overall iodide content, the presence/absence of a reduction-sensitized region, the use of selenium sensitization, the use of tellurium sensitization, the average projected area diameter, the average aspect ratio, and the ratio of the sum of the projected areas of grains, which have an aspect ratio of 2 to 30 and a projected area diameter of 0.08 μm to 0.5 μm and in which iodide ions in an outer shell region (outer shell region (40)), which is 40% from the grain surface, are 5 mol % to 20 mol % of a silver halide in this outer shell region, to the total projected area of all grains.

TABLE 1

| Emulsion | Average iodide content based on silver halides in a whole grain | Presence or absence of a reduction-sensitized region present: ○; absent: X | Use of selenium sensitization Used: ○; not used: X | Use of tellurium sensitization Used: ○; not used: X | Average diameter of projected area (μm) | Average aspect ratio | Ratio of tabular grains[1)] (%) | |
|---|---|---|---|---|---|---|---|---|
| Em-a' | 3.5 | X | X | X | 0.32 | 4.5 | 53 | Comp. |
| Em-b' | 3.5 | X | X | X | 0.31 | 4.4 | 82 | Inv. |

TABLE 1-continued

| Emulsion | Average iodide content based on silver halides in a whole grain | Presence or absence of a reduction-sensitized region present: ○; absent: X | Use of selenium sensitization Used: ○; not used: X | Use of tellurium sensitization Used: ○; not used: X | Average diameter of projected area (μm) | Average aspect ratio | Ratio of tabular grains[1)] (%) | |
|---|---|---|---|---|---|---|---|---|
| Em-c' | 3.5 | X | X | X | 0.31 | 4.5 | 85 | Inv. |
| Em-d' | 3.5 | X | X | X | 0.31 | 4.4 | 86 | Inv. |
| Em-e' | 3.5 | X | X | X | 0.31 | 4.5 | 85 | Inv. |
| Em-f' | 8.0 | X | X | X | 0.31 | 4.5 | 83 | Inv. |
| Em-g' | 10.0 | X | X | X | 0.31 | 4.5 | 60 | Comp. |
| Em-h | 3.5 | ○ | X | X | 0.32 | 4.5 | 55 | Comp. |
| Em-i | 3.5 | ○ | X | X | 0.31 | 4.4 | 83 | Inv. |
| Em-j | 3.5 | ○ | X | X | 0.31 | 4.4 | 85 | Inv. |
| Em-k | 3.5 | X | ○ | X | 0.32 | 4.5 | 51 | Comp. |
| Em-l | 3.5 | X | ○ | X | 0.31 | 4.4 | 83 | Inv. |
| Em-m | 3.5 | X | ○ | X | 0.31 | 4.4 | 83 | Inv. |
| Em-n | 3.5 | ○ | ○ | ○ | 0.32 | 4.5 | 49 | Comp. |
| Em-o | 3.5 | ○ | ○ | ○ | 0.31 | 4.4 | 82 | Inv. |
| Em-p | 3.5 | ○ | ○ | ○ | 0.31 | 4.4 | 83 | Inv. |
| Em-q | 8.0 | ○ | ○ | ○ | 0.31 | 4.5 | 80 | Inv. |
| Em-r | 10.0 | ○ | ○ | ○ | 0.31 | 4.5 | 62 | Comp. |
| Em-s | 3.5 | X | X | X | 0.60 | 4.5 | 5 | Comp. |
| Em-t | 3.5 | X | X | X | 0.60 | 4.5 | 35 | Comp. |
| Em-u | 3.5 | X | X | X | 0.60 | 4.5 | 30 | Comp. |
| Em-v | 3.5 | X | X | X | 0.60 | 4.5 | 31 | Comp. |
| Em-w | 3.5 | X | X | X | 0.60 | 4.5 | 31 | Comp. |
| Em-X | 8.0 | X | X | X | 0.60 | 4.5 | 22 | Comp. |
| Em-y | 10.0 | X | X | X | 0.60 | 4.5 | 10 | Comp. |

Note:
[1)]The ratio of the sum of the total projected area of the grains having 5 to 20 mol% of iodide ions in a region that is 40% in volume from a grain surface, the diameter of a projected area of 0.08 to 0.05 μm and the aspect ratio of 2 to 30, based on the total sum of the projected area of all the grains.

The compound described below was added to the emulsions Em-a' to Em-g', Em-h to Em-r, and Em-s to Em-y. Each resultant emulsion was applied together with a protective layer on a triacetylcellulose film support having an undercoat layer by a simultaneous extrusion method, thereby forming samples 101 to 125.

(1) Emulsion Layers

Emulsions: emulsions Em-a' to Em-g', emulsions Em-h to Em-r, and Em-s to Em-y (respectively corresponding to samples 101 to 125)

Stabilizer:

4-hydroxy-6-methyl-1,3,3a,7-tetraazaindene (2) Protective Layer

Gelatin

These samples were given appropriate sensitometry exposure (1 sec) with light transmitted through a Fuji Filter SC50 and subjected to black-and-white development at 20° C. for 10 min by using a developer D-19 having the following composition. Thereafter, each resultant sample was stopped, fixed, washed with water, and dried, and the density of each sample was measured.

The composition of the processing solution D-19 is as follows:

| | |
|---|---|
| Metol | 2.2 g |
| $Na_2SO_3.7H_2O$ | 96 g |
| Hydroquinone | 8.8 g |
| $Na_2CO_3$ | 56 g |

-continued

| | |
|---|---|
| KBr | 5.0 g |
| Water to make | 1.0 L |

Table 2 below shows the results.

The sensitivity is defined by a reciprocal of an exposure amount (E) by which a density half the sum of the fog and the maximum density is given. The sensitivity of each of the samples 101 to 118 is the sensitivity difference, indicated by a logE relative value, from the value of the sample 101. The sensitivity of each of the samples 119 to 125 is the sensitivity difference, indicated by a logE relative value, from the value of the sample 119. The graininess was obtained by measuring the RMS granularity at a density half the sum of the fog and the maximum density. The graininess of each of the samples 101 to 118 is represented by a relative value with respect to a standard value of 100 of the sample 101. The graininess of each of the samples 119 to 125 is represented by a relative value with respect to a value of 100 of the sample 119. The total performance was evaluated by the combination of the sensitivity and the graininess. In order to obtain the total performance, graininess was converted into sensitivity as set forth below. An essential grain size was obtained with the final number of grains by using the ratio of the square of the RMS granularity, and converting the value assuming that its logarithm was equivlent to the sensitivity expressed in logE. The logE value calculated from the graininess was added to the photographic sensitivity to estimate the preformance.

TABLE 2

| Coated sample | Emulsion used | Fogging | Sensitivity (log E) (A) | RMS granularity | Sensitivity estimated from the granularity (log E) (B) | Total performance of sensitivity and granularity (A) + (B) | |
|---|---|---|---|---|---|---|---|
| 101 | Em-a' | 0.02 | 0 (control) | 100 (control) | 0 (control) | 0.00 | Comp. |
| 102 | Em-b' | 0.02 | 0.09 | 86.1 | 0.13 | 0.22 | Inv. |
| 103 | Em-c' | 0.02 | 0.09 | 84.1 | 0.15 | 0.24 | Inv. |
| 104 | Em-d' | 0.03 | 0.09 | 81.3 | 0.18 | 0.27 | Inv. |
| 105 | Em-e' | 0.02 | 0.08 | 81.2 | 0.18 | 0.27 | Inv. |
| 106 | Em-f' | 0.02 | 0.05 | 79.5 | 0.20 | 0.25 | Inv. |
| 107 | Em-g' | 0.02 | −0.11 | 78.5 | 0.21 | 0.10 | Comp. |
| 108 | Em-h | 0.05 | 0.52 | 127.4 | −0.21 | 0.31 | Comp. |
| 109 | Em-i | 0.03 | 0.45 | 94.4 | 0.05 | 0.50 | Inv. |
| 110 | Em-j | 0.03 | 0.51 | 88.1 | 0.11 | 0.62 | Inv. |
| 111 | Em-k | 0.03 | 0.70 | 102.3 | −0.02 | 0.68 | Comp. |
| 112 | Em-1 | 0.02 | 0.78 | 84.0 | 0.15 | 0.92 | Inv. |
| 113 | Em−m | 0.02 | 0.85 | 84.2 | 0.15 | 1.00 | Inv. |
| 114 | Em-n | 0.07 | 1.15 | 135.1 | −0.26 | 0.94 | Comp. |
| 115 | Em-o | 0.04 | 1.17 | 86.2 | 0.13 | 1.30 | Inv. |
| 116 | Em-p | 0.03 | 1.22 | 85.0 | 0.14 | 1.36 | Inv. |
| 117 | Em-q | 0.03 | 1.19 | 80.5 | 0.19 | 1.38 | Inv. |
| 118 | Em-r | 0.03 | 0.83 | 79.3 | 0.20 | 1.03 | Comp. |
| 119 | Em-s | 0.03 | 0 (control) | 100 (control) | 0 (control) | 0 | Comp. |
| 120 | Em-t | 0.03 | 0.05 | 98.9 | 0.01 | 0.06 | Comp. |
| 121 | Em-u | 0.03 | 0.05 | 97.7 | 0.02 | 0.07 | Comp. |
| 122 | Em-v | 0.03 | 0.06 | 99.0 | 0.01 | 0.07 | Comp. |
| 123 | Em-w | 0.02 | 0.03 | 98.2 | 0.01 | 0.04 | Comp. |
| 124 | Em-x | 0.02 | 0.01 | 94.3 | 0.05 | 0.04 | Comp. |
| 125 | Em-y | 0.02 | −0.10 | 89.0 | 0.10 | 0 | Comp. |

In a silver halide having a grain size of 0.70 μm (the samples 119 to 125), it was impossible to clearly find a region having high total performance, which is the combination of the sensitivity and the graininess, by changing the iodide ratio on the outer shell. However, when the grain size was 0.31 μm, it was obvious that the sensitivity was increased while the grain roughness was well suppressed by depositing a relatively high-iodide layer in the outer shell region (40) of a grain. It was found that reduction sensitization and selenium-tellurium sensitization were sensitivity increasing means particularly effective for a grain having a relatively high-iodide layer on the grain surface.

Note that the properties such as the sensitivity and the graininess described above must be compared in each of blocks of 101 to 107, 108 to 110, 111 to 113, 114 to 118, and 119 to 125, because the sensitization method differs from one block to another.

Example 2

Preparation of Em-1

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 225 g of KBr in 1 L and an aqueous solution containing 316 g of silver nitrate and 0.6 g of ammonium nitrate in 1 L were added over 13.5 min by a double-jet method. During the addition, the pAg was held at 8.5. In this addition (2), 24.3% of the total silver amount were consumed. Subsequently, an aqueous solution containing 30.0 g of KI in 100 cc and an aqueous solution containing 320 g of silver nitrate and 0.57 g of ammonium nitrate in 1 L were added over 3 min by a double-jet method. In this addition (3), 5.0% of the total silver amount were consumed. The aqueous solution containing 225 g of KBr in 1 L and the aqueous solution containing 316 g of silver nitrate and 0.6 g of ammonium nitrate in 1 L were again added over 18 min by a double-jet method. During the addition, the pAg was held at 8.5. In this addition (4), 65% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (I=4.0 mol %) Em-l having an average grain diameter of 0.25 μm as the diameter of a sphere having the same volume, an average projected area diameter of 0.27 μm, and an average aspect ratio of 1.9.

Preparation of Em-2

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 214.4 g of KBr and 13.2 g of KI in 1 L and an aqueous solution containing 320 g of silver nitrate and 0.57 g of ammonium nitrate in 1 L were added over 28 min by a double-jet method. During the addition, the pAg was held at 8.5. In this addition (2), 94.3% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (I=4.0 mol %) Em-2 having an average grain diameter of 0.25 μm as the diameter of a sphere having the same volume, an average projected area diameter of 0.32 μm, and an average aspect ratio of 3.0.

Preparation of Emulsion Em-3

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 225 g of KBr in 1 L and an aqueous solution containing 316 g of silver nitrate and 0.6 g of ammonium nitrate in 1 L were added over 13.5 min by a double-jet method. During the addition, the pAg was held at 8.5. In this addition (2), 24.3% of the total silver amount were consumed. Subsequently, an aqueous solution containing 211.2 g of KBr and 17.8 g of KI in 1 L and an aqueous solution containing 320 g of silver nitrate and 0.57 g of ammonium nitrate in 1 L were added over 15 min by a double-jet method. During the addition, the pAg was held at 8.5. In this addition (3), 70% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=4.0 mol %) Em-3 having an average grain diameter of 0.25 μm as the diameter of a sphere having the same volume, an average projected area diameter of 0.31 μm, and an average aspect ratio of 3.0.

Preparation of Em-4

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 225 g of KBr in 1 L and an aqueous solution containing 316 g of silver nitrate and 0.6 g of ammonium nitrate in 1 L were added over 22 min by a double-jet method. During the addition, the pAg was held at 8.5. In this addition (2), 59.3% of the total silver amount were consumed. Subsequently, an aqueous solution containing 198.4 g of KBr and 35.7 g of KI in 1 L and an aqueous solution containing 320 g of silver nitrate and 0.57 g of ammonium nitrate in 1 L were added over 6 min by a double-jet method. During the addition, the pAg was held at 8.7. In this addition (3), 35% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=4.0 mol %) Em-4 having an average grain diameter of 0.25 μm as the diameter of a sphere having the same volume, an average projected area diameter of 0.38 μm, and an average aspect ratio of 5.2.

Preparation of Em-5

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred.

During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 225 g of KBr in 1 L and an aqueous solution containing 316 g of silver nitrate and 0.6 g of ammonium nitrate in 1 L were added over 16 min by a double-jet method . During the addition, the pAg was held at 8.7. In this addition (2), 74.3% of the total silver amount were consumed. Subsequently, an aqueous solution containing 179.1 g of KBr and 62.5 g of KI in 1 L and an aqueous solution containing 320 g of silver nitrate and 0.57 g of ammonium nitrate in 1 L were added over 3 min by a double-jet method. During the addition, the pAg was held at 8.7. In this addition (3), 20% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=4.0 mol %) Em-5 having an average grain diameter of 0.25 μm as the diameter of a sphere having the same volume, an average projected area diameter of 0.42 μm, and an average aspect ratio of 7.1.

Preparation of Emulsion Em-6

An aqueous solution containing 70.8 g of KBr and 11.0 g of low-molecular-weight gelatin having an average molecular weight of 10,000 to 20,000 in 500 cc and an aqueous solution containing 100 g of silver nitrate and 4.62 g of ammonium nitrate in 500 cc were added at 35° C. over 40 sec by a double-jet method to an aqueous solution prepared by dissolving 6 g of potassium bromide and 0.8 g of the low-molecular-weight gelatin in 1.5 L of distilled water while the solution was well stirred. During the addition, the pAg was held at 9.0. In this addition (1), 5.7% of the total silver amount were consumed. After the pAg was adjusted to 9.5 by an aqueous KBr solution, the solution temperature was raised to 50° C. Thereafter, 35 g of gelatin processed with phthalic acid were added, and an aqueous solution containing 225 g of KBr in 1 L and an aqueous solution containing 316 g of silver nitrate and 0.6 g of ammonium nitrate in 1 L were added over 22 min by a double-jet method. During the addition, the pAg was held at 8.6. In this addition (2), 74.3% of the total silver amount were consumed. Subsequently, an aqueous solution containing 30.0 g of KI in 100 cc and an aqueous solution containing 320 g of silver nitrate and 0.57 g of ammonium nitrate in 1 L were added over 3 min by a double-jet method. In this addition (3), 5.0% of the total silver amount were consumed. The aqueous solution containing 225 g of KBr in 1 L and the aqueous solution containing 316 g of silver nitrate and 0.6 g of ammonium nitrate in 1 L were again added over 4 min by a double-jet method. During the addition, the pAg was held at 8.7. In this addition (4), 15% of the total silver amount were consumed. Subsequently, the resultant emulsion was washed with water at 35° C. by a well-known flocculation method, gelatin was added, and the pH and the pAg were adjusted to 6.3 and 8.3, respectively, at 40° C. The result was a tabular AgBrI emulsion (average I=4.0 mol %) Em-6 having an average grain diameter of 0.25 μm as the diameter of a sphere having the same volume, an average projected area diameter of 0.40 μm, and an average aspect ratio of 6.2.

Preparation of Em-7

The prepared emulsion Em-5 as a host grain was dissolved at 40° C. and made adsorb sensitizing dyes S-4 and S-6 (to be presented later). Thereafter, an aqueous solution containing 16.2 g of NaCl in 100 cc and an aqueous solution containing 23.6 g of $AgNO_3$ in 100 cc were simultaneously added to form a silver chloride epitaxially grown portion having a silver amount of 10 mol % with respect to the silver amount of the host grain, thereby preparing Em-7.

Preparation of Em-8

The prepared emulsion Em-5 was dissolved at 40° C. and made adsorb the sensitizing dyes S-4 and S-6. Thereafter, 4 mol % of NaCl, 4 mol % of KBr, and 2 mol % of KI with respect to the silver amount of the host grain were added by using an aqueous solution containing 16.2 g of NaCl in 100 cc, an aqueous solution containing 33.0 g of KBr in 100 cc, and an aqueous solution containing 15.3 g of KI in 100 cc, respectively. Immediately after the addition, an aqueous solution containing 23.6 g of $AgNO_3$ in 100 cc was added to form a silver bromochloroiodide epitaxially grown portion having a silver amount of 10 mol % with respect to the silver amount of the host grain, thereby preparing Em-8.

Preparation of Em-9

The prepared emulsion Em-5 was dissolved at 40° C. and made adsorb the sensitizing dyes S-4 and S-6. Thereafter, an aqueous solution containing 5.4 g of NaCl and 22.0 g of KBr in 100 cc and an aqueous solution containing 23.6 g of $AgNO_3$ in 100 cc were simultaneously added to form of a silver chlorobromide epitaxially grown portion having a silver amount of 15 mol % with respect to the silver amount of the host grain, thereby preparing Em-9.

Preparation of Em-10

The prepared emulsion Em-6 was dissolved at 40° C. and formed a silver chlorobromide epitaxially grown portion having a silver amount of 15 mol % with respect to the silver amount of the host grain, following the same procedure as for Em-9, thereby preparing Em-10.

Preparation of Em-11

Em-11 was prepared following the same procedure as for Em-10 except that Em-6' described below was used instead of Em-6.

Preparation of Em-12

Em-12 was prepared following the same procedure as for Em-10 except that Em-6" described below was used instead of Em-6.

Preparation of Em-6' and Em-6"

Em-6' was prepared following the same procedure as for Em-6 except that process (4) was performed over 3.2 min. Analogously, Em-6" was prepared following the same procedure as for Em-6 except that process (4) was performed over 2.6 min and the pAg was held at 8.8 during the process.

Table 3 below shows the data of an emulsion F and the emulsions Em-1 to Em-12. The data includes the average overall iodide content, the average diameter as the diameter of a sphere having the same volume, the average projected area diameter, the average aspect ratio, the presence/absence of dislocation lines, the presence/absence of an epitaxially grown portion, and the ratio of the sum of the projected areas of grains, which have an aspect ratio of 2 to 30 and a projected area diameter of 0.08 μm to 0.5 μm and in which iodide ions in an outer shell region (outer shell region (40)), which is 40% from the grain surface, are 5 mol % to 20 mol % of a silver halide in this outer shell region, to the sum of all projected areas.

TABLE 3

| Emulsion | Average iodide content based on silver holides in a whole grain (mol%) | Average diameter of equivalent sphere having the same volume (μm) | Average diameter of equivalent circle having the same area (μm) | Average aspect ratio | Presence or absence of dislocation lines present: ○; absent: X | Presence or absence of epitaxial present: ○; absent: X | Ratio of tabular grains[1)] (%) | |
|---|---|---|---|---|---|---|---|---|
| F | 4.0 | 0.25 | 0.37 | 5.0 | ○ | X | 0 | Comp. |
| Em-1 | 4.0 | 0.25 | 0.27 | 1.9 | ○ | X | 0 | Comp. |
| Em-2 | 4.0 | 0.25 | 0.32 | 3.0 | X | X | 51 | Comp. |
| Em-3 | 4.0 | 0.25 | 0.31 | 3.0 | X | X | 85 | Inv. |
| Em-4 | 4.0 | 0.24 | 0.38 | 5.2 | X | X | 84 | Inv. |
| Em-5 | 4.0 | 0.24 | 0.42 | 7.1 | X | X | 84 | Inv. |
| Em-6 | 4.0 | 0.24 | 0.40 | 6.2 | ○ | X | 82 | Inv. |
| Em-7 | 4.0 | 0.25 | 0.42 | 7.3 | X | ○ | 82 | Inv. |
| Em-8 | 4.0 | 0.25 | 0.42 | 7.2 | X | ○ | 82 | Inv. |
| Em-9 | 4.0 | 0.25 | 0.42 | 7.3 | X | ○ | 82 | Inv. |
| Em-10 | 4.0 | 0.25 | 0.40 | 6.3 | ○ | ○ | 83 | Inv. |
| Em-11 | 4.0 | 0.25 | 0.40 | 6.3 | ○ | ○ | 75 | Comp. |
| Em-12 | 4.0 | 0.25 | 0.40 | 6.3 | ○ | ○ | 61 | Comp. |

Note:
[1)]The ratio of the sum of the total projected area of the grains having 5 to 20 mol% of iodide ions in a region that is 40% in volume from a grain surface, the diameter of a projected area of 0.08 to 0.5 μm and the aspect ratio of 2 to 30, based on the total sum of the projected area of all the grains.

The emulsion F and the emulsions Em-1 to Em-6 were heated to 45° C. and made adsorb the sensitizing dyes S-4 and S-6 described below. Thereafter, these emulsions were further heated to 56° C. and optimally chemically sensitized by adding potassium thiocyanate, chloroauric acid, hypo, and diphenyl(pentafluorophenyl)phosphine selenide as a selenium sensitizer. The emulsions Em-7 to Em-12 were already made adsorb the dyes. Therefore, these emulsions were heated to 45° C. and optimally chemically sensitized by adding potassium thiocyanate, chloroauric acid, hypo, and diphenyl(pentafluorophenyl)phosphine selenide as a selenium sensitizer.

Formation of Sample 201

A multilayered color sensitive material constituted by layers having the following compositions was formed on an undercoated cellulose triacetate film support having a thickness of 127 μm, thereby forming a sample 201. Numbers represent addition amounts per $m^2$ of the material. Note that the effects of the added compounds are not limited to those described below.

| | | | |
|---|---|---|---|
| 1st layer: Antihalation layer | | | |
| Black colloidal silver | | 0.10 | g |
| Gelatin | | 1.90 | g |
| Ultraviolet absorbent U-1 | | 0.10 | g |
| Ultraviolet absorbent U-3 | | 0.040 | g |
| Ultraviolet absorbent U-4 | | 0.10 | g |
| High-boiling organic solvent Oil-1 | | 0.10 | g |
| Fine crystal solid dispersion of dye E-1 | | 0.10 | g |
| 2nd layer: Interlayer | | | |
| Gelatin | | 0.40 | g |
| Compound Cpd-C | | 5.0 | mg |
| Compound Cpd-I | | 5.0 | mg |
| Compound Cpd-J | | 3.0 | mg |
| High-boiling organic solvent Oil-3 | | 0.10 | g |
| Dye D-4 | | 0.80 | mg |
| 3rd layer: Interlayer | | | |
| Fine grain silver iodobromide emulsion fogged both on surface and in interior (average grain size = 0.06 μm, variation coefficient = 18%, AgI content = 1 mol %) | silver | 0.050 | g |
| Yellow colloidal silver | silver | 0.030 | g |
| Gelatin | | 0.40 | g |
| 4th layer: Low-speed red-sensitive emulsion layer | | | |
| Emulsion A | silver | 0.30 | g |
| Emulsion B | silver | 0.20 | g |
| Gelatin | | 0.80 | g |
| Coupler C-1 | | 0.15 | g |
| Coupler C-2 | | 0.050 | g |
| Compound Cpd-C | | 5.0 | mg |
| Compound Cpd-J | | 5.0 | mg |
| High-boiling organic solvent Oil-2 | | 0.10 | g |
| Additive P-1 | | 0.10 | g |
| 5th layer: Medium-speed red-sensitive emulsion layer | | | |
| Emulsion C | silver | 0.50 | g |
| Gelatin | | 0.80 | g |
| Coupler C-1 | | 0.20 | g |
| Coupler C-2 | | 0.050 | g |
| High-boiling organic solvent Oil-2 | | 0.10 | g |
| Additive P-1 | | 0.10 | g |
| 6th layer: High-speed red-sensitive emulsion layer | | | |
| Emulsion D | silver | 0.40 | g |
| Gelatin | | 1.10 | g |
| Coupler C-1 | | 0.30 | g |
| Coupler C-2 | | 0.10 | g |
| Coupler C-5 | | 0.02 | g |
| Additive P-1 | | 0.10 | g |

-continued

| | | | |
|---|---|---|---|
| 7th layer: Interlayer | | | |
| Gelatin | | 0.60 | g |
| Additive M-1 | | 0.30 | g |
| Color-mixing inhibitor Cpd-I | | 2.6 | mg |
| Dye D-5 | | 0.020 | g |
| Compound Cpd-J | | 5.0 | mg |
| High-boiling organic solvent Oil-2 | | 0.020 | g |
| 8th layer: Interlayer | | | |
| Gelatin | | 1.00 | g |
| Additive P-1 | | 0.20 | g |
| Color-mixing inhibitor Cpd-A | | 0.10 | g |
| Compound Cpd-C | | 0.10 | g |
| Compound Cpd-L | | 3.0 | mg |
| 9th layer: Low-speed green-sensitive emulsion layer | | | |
| Emulsion E | silver | 0.20 | g |
| Emulsion F | silver | 0.30 | g |
| Gelatin | | 0.50 | g |
| Coupler C-3 | | 0.10 | g |
| Coupler C-6 | | 0.050 | g |
| Coupler C-7 | | 0.20 | g |
| Compound Cpd-B | | 0.030 | g |
| Compound Cpd-D | | 0.020 | g |
| Compound Cpd-E | | 0.020 | g |
| Compound Cpd-F | | 0.040 | g |
| Compound Cpd-I | | 10 | mg |
| Compound Cpd-K | | 0.020 | g |
| High-boiling organic solvent Oil-1 | | 0.10 | g |
| High-boiling organic solvent Oil-2 | | 0.10 | g |
| 10th layer: Medium-speed green-sensitive emulsion layer | | | |
| Emulsion G | silver | 0.40 | g |
| Gelatin | | 0.60 | g |
| Coupler C-3 | | 0.100 | g |
| Coupler C-6 | | 0.200 | g |
| Coupler C-7 | | 0.100 | g |
| Compound Cpd-B | | 0.030 | g |
| Compound Cpd-D | | 0.020 | g |
| Compound Cpd-E | | 0.020 | g |
| Compound Cpd-F | | 0.050 | g |
| Compound Cpd-K | | 0.050 | g |
| High-boiling organic solvent Oil-2 | | 0.010 | g |
| 11th layer: High-speed green-sensitive emulsion layer | | | |
| Emulsion H | silver | 0.50 | g |
| Gelatin | | 1.00 | g |
| Coupler C-3 | | 0.30 | g |
| Coupler C-6 | | 0.10 | g |
| Coupler C-7 | | 0.10 | g |
| Compound Cpd-B | | 0.080 | g |
| Compound Cpd-E | | 0.020 | g |
| Compound Cpd-F | | 0.040 | g |
| Compound Cpd-J | | 5.0 | mg |
| Compound Cpd-K | | 0.020 | g |
| High-boiling organic solvent Oil-1 | | 0.020 | g |
| High-boiling organic solvent Oil-2 | | 0.020 | g |
| 12th layer: Interlayer | | | |
| Gelatin | | 0.60 | g |
| Compound Cpd-K | | 0.050 | g |
| High-boiling organic solvent Oil-1 | | 0.050 | g |
| 13th layer: Yellow filter layer | | | |
| Yellow colloidal silver | silver | 0.070 | g |
| Gelatin | | 1.10 | g |
| Color-mixing inhibitor Cpd-A | | 0.010 | g |
| Compound Cpd-K | | 0.010 | g |
| High-boiling organic solvent Oil-1 | | 0.010 | g |
| Fine crystal solid dispersion of dye E-2 | | 0.050 | g |
| 14th layer: Low-speed blue-sensitive emulsion layer | | | |
| Emulsion I | silver | 0.20 | g |
| Emulsion J | silver | 0.30 | g |
| Gelatin | | 0.80 | g |

-continued

| | | |
|---|---|---|
| Coupler C-4 | | 0.20 g |
| Coupler C-5 | | 0.10 g |
| Coupler C-8 | | 0.40 g |
| 15th layer: Medium-speed blue-sensitive emulsion layer | | |
| Emulsion K | silver | 0.50 g |
| Gelatin | | 0.90 g |
| Coupler C-4 | | 0.10 g |
| Coupler C-5 | | 0.10 g |
| Coupler C-8 | | 0.60 g |
| 16th layer: High-speed blue-sensitive emulsion layer | | |
| Emulsion L | silver | 0.40 g |
| Gelatin | | 1.20 g |
| Coupler C-4 | | 0.10 g |
| Coupler C-5 | | 0.60 g |
| Coupler C-8 | | 0.10 g |
| 17th layer: 1st protective layer | | |
| Gelatin | | 0.70 g |
| Ultraviolet absorbent U-1 | | 0.20 g |
| Ultraviolet absorbent U-2 | | 0.050 g |
| Ultraviolet absorbent U-5 | | 0.30 g |
| Formalin scavenger Cpd-G | | 0.40 g |
| Dye D-1 | | 0.15 g |
| Dye D-2 | | 0.050 g |
| Dye D-3 | | 0.10 g |
| 18th layer: 2nd protective layer | | |
| Colloidal silver | silver | 0.10 mg |
| Fine grain silver iodobromide emulsion (average grain size = 0.06 μm, AgI content = 1 mol %) | silver | 0.10 g |
| Gelatin | | 0.40 g |
| 19th layer: 3rd protective layer | | |
| Gelatin | | 0.40 g |
| Polymethylmethacrylate (average grain size = 1.5 μm) | | 0.10 g |
| 4:6 copolymer of methylmethacrylate and acrylic acid (average grain size = 1.5 μm) | | 0.10 g |
| Silicone oil Cpd-S | | 0.030 g |
| Surfactant W-1 | | 3.0 mg |
| Surfactant W-2 | | 0.030 g |

In addition to the above compositions, additives F-1 to F-8 were added to all the emulsion layers. The layers were also added with a gelatin hardener H-1 and surfactants W-3, W-4, W-5, and W-6, for coating and emulsification.

In addition, phenol, 1,2-benzisothiazoline-3-one, 2-phenoxyethanol, phenethylalcohol, and p-benzoic butylester were added as antiseptic and mildewproofing agents.

Preparation of Dispersion of Organic Solid Disperse Dye

A dye E-1 was dispersed by the following method. That is, water and 200 g of Pluronic F88 (ethyleneoxide-propyleneoxide block copolymer) manufactured by BASF Co. were added to 1430 g of a wet cake of a dye containing 30% of methanol, and the resultant material was stirred to form a slurry having a dye concentration of 6%. Subsequently, 1700 mL of zirconia beads with an average diameter of 0.5 mm were filled in an ultra visco mill (UVM-2) manufactured by Aimex K.K., and the material was milled for 8 h at a peripheral speed of about 10 m/sec and a discharge amount of 0.5 L/min. The beads were removed by filtration, and water was added to dilute the material to have a dye concentration of 3%. Thereafter, the resultant material was heated at 90° C. for 10 h for stabilization. The average grain size of the resultant fine dye grains was 0.60 μm, and the expansion of the grain size distribution (grain size standard deviation ×100/average grain size) of the grains was 18%.

Following the same procedure as above, solid dispersions of dyes E-2 and E-3 were prepared. The average grain sizes were 0.54 μm and 0.56 μm, respectively.

C-1

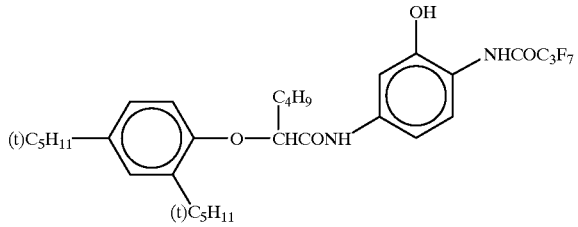

C-2

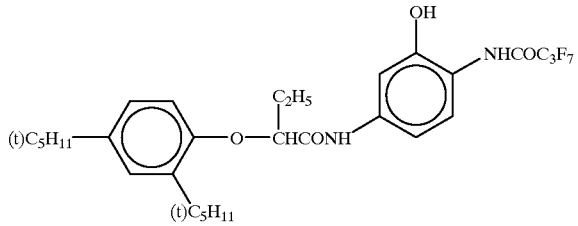

C-3

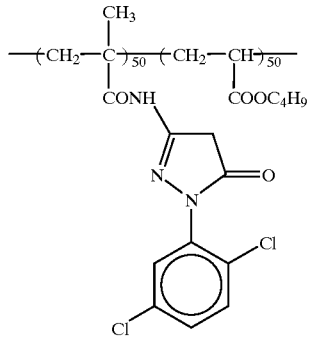

The numbers are expressed in weight %
Average moelcular weight: about 25,000

C-4

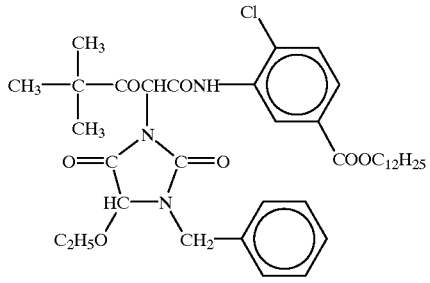

C-5

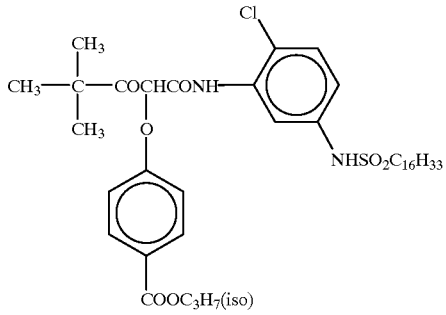

-continued
C-6
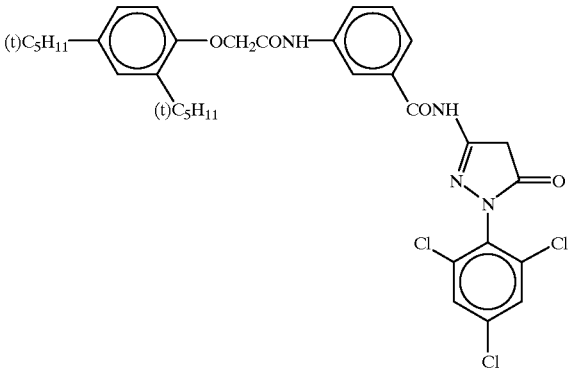
C-7
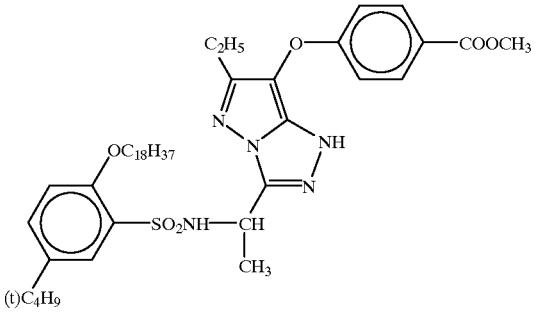
C-8
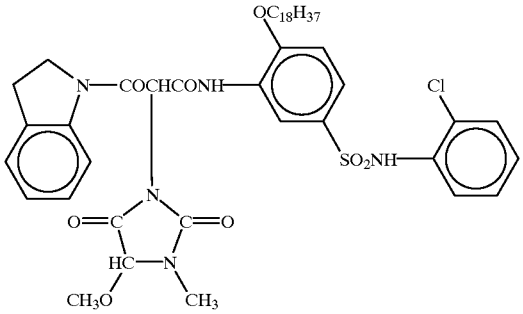
Oil-1
Dibutyl phthalate
Oil-2
Tricresyl phosphate
Oil-3
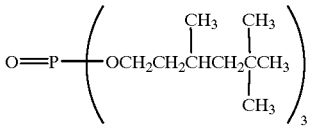
Cpd-A
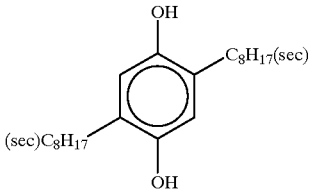
-continued
Cpd-B
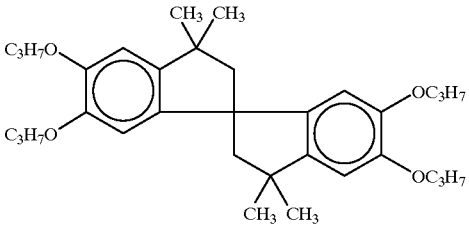
Cpd-C
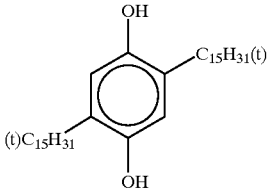
Cpd-D
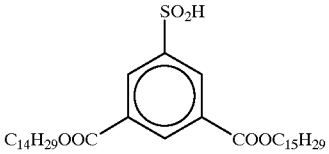
Cpd-E
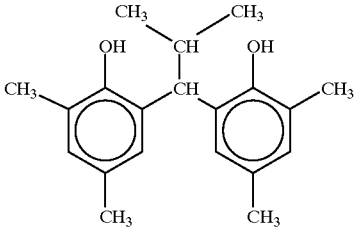
Cpd-F
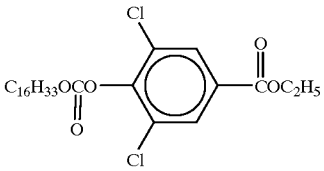
Cpd-G
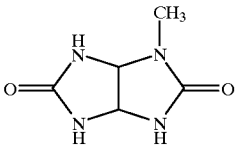
Cpd-I
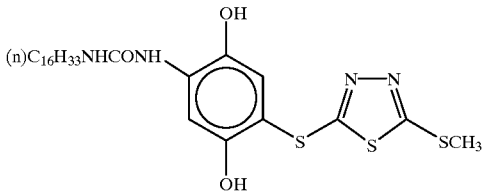

-continued
Cpd-J
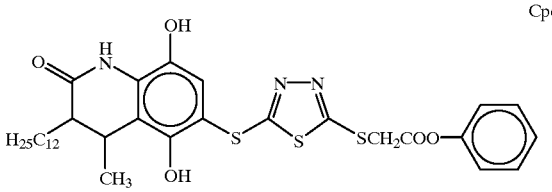
Cpd-K
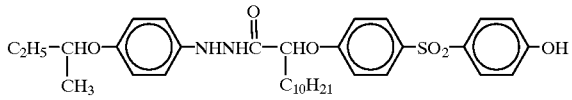
Cpd-L
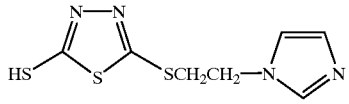
Cpd-S
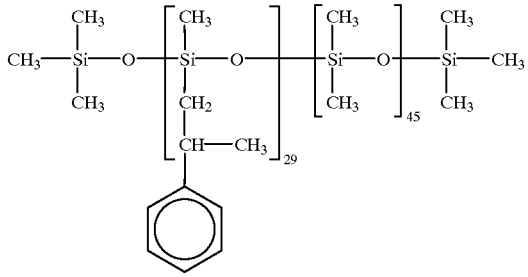
U-1
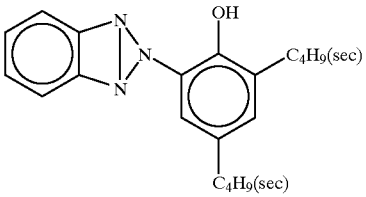
U-2
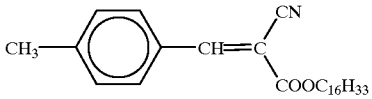
U-3
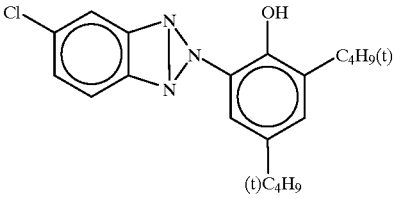
U-4
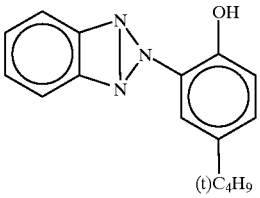
-continued
U-5
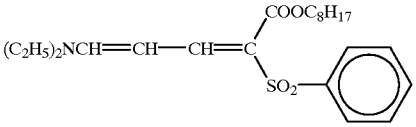
D-1
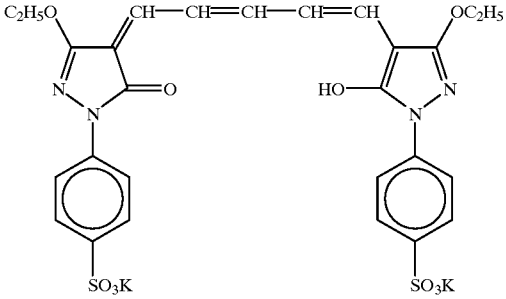
D-2
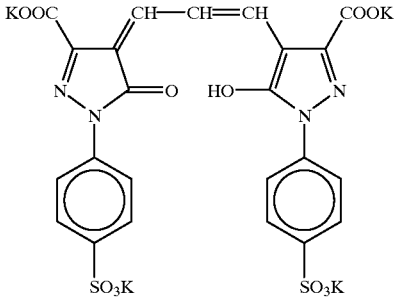
D-3
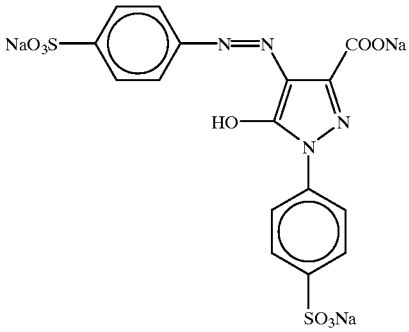
D-4
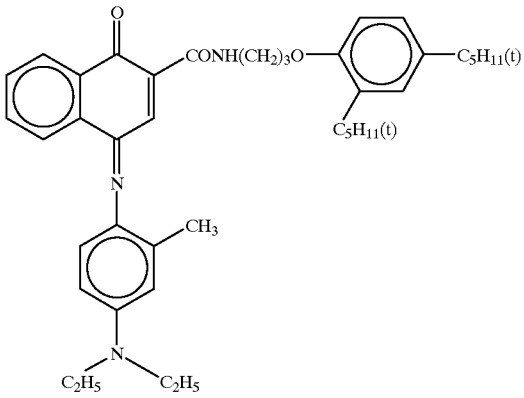

-continued
D-5
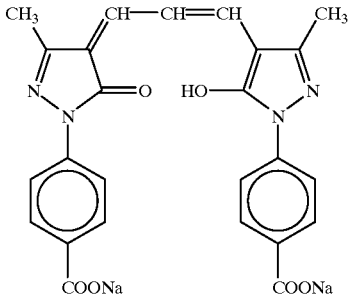
E-1
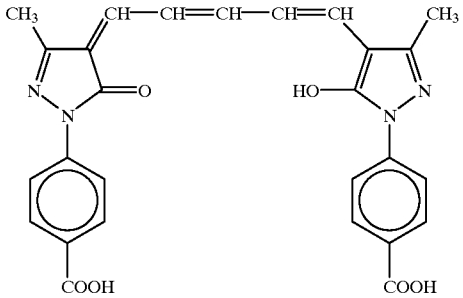
E-2
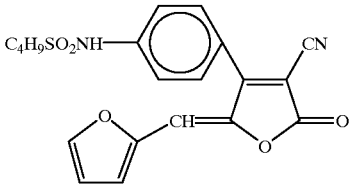
H-1
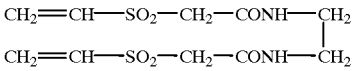
W-1
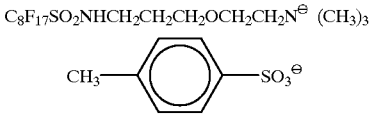
W-2
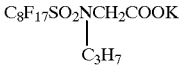
W-3
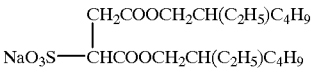
W-4
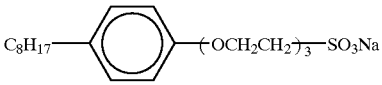
W-5
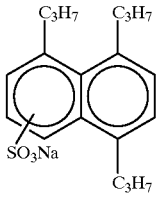
-continued
W-6
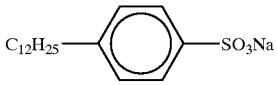
P-1
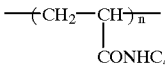
n = 100–1,000
M-1
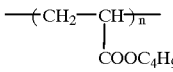
n = 100–1,000
F-1
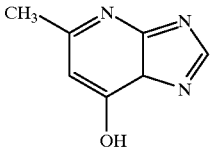
F-2
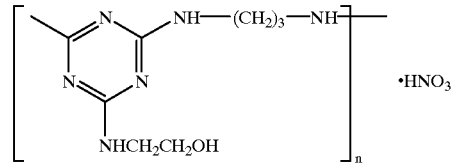
n = 3–4
F-3
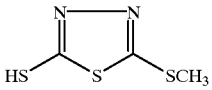
F-4
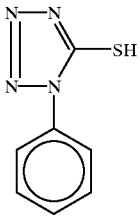
F-5
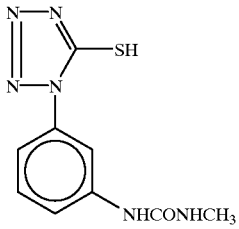
F-6
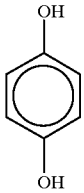

-continued

F-7

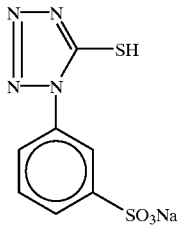

F-8

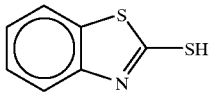

S-1

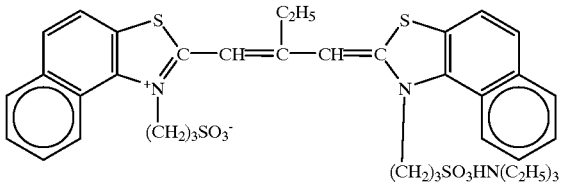

S-2

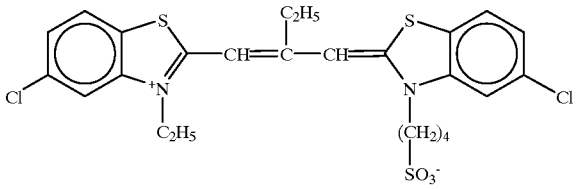

S-3

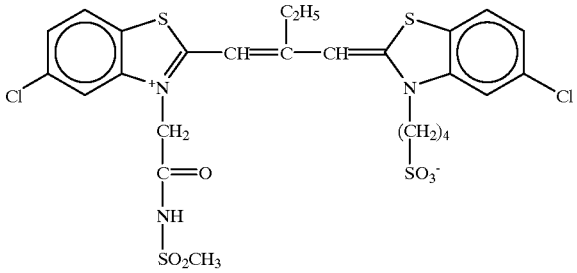

-continued

S-4

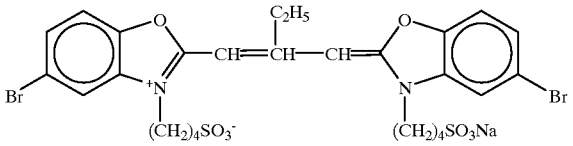

S-5

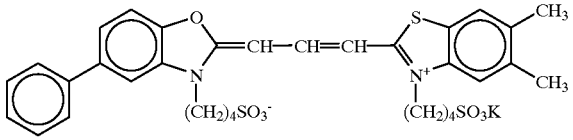

S-6

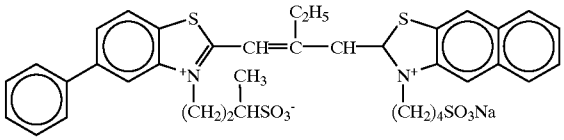

S-7

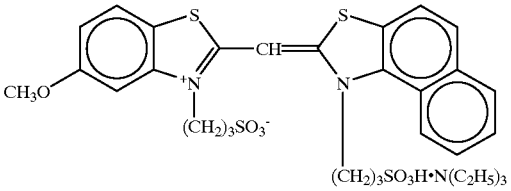

S-8

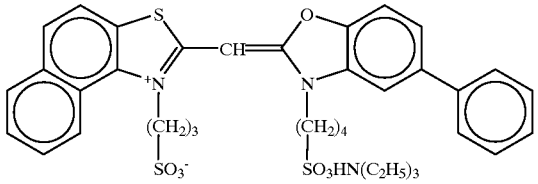

The silver bromoiodide emulsions used in the sample 201 where as follow.

TABLE 4

| Emulsion | Characteristics of grains | Average diameter of equivalent sphere (μm) | Ratio in projected area (%) | Variation coefficient of distribution of grain size (%) | AgI content (%) |
|---|---|---|---|---|---|
| A | Tabular grains having AAR[1)] of 5.0 | 0.20 | 60 | 25 | 3.5 |
| B | Internally-fogged tabular grains having AAR of 5.0 | 0.25 | 65 | 25 | 3.5 |
| C | Tabular grains having AAR of 8.0 | 0.31 | 95 | 25 | 3.0 |
| D | Tabular grains having AAR of 7.1 | 0.56 | 97 | 15 | 2.0 |
| E | Tabular grains having AAR of 3.5 | 0.15 | 60 | 30 | 4.0 |

TABLE 4-continued

| Emulsion | Characteristics of grains | Average diameter of equivalent sphere (μm) | Ratio in projected area (%) | Variation coefficient of distribution of grain size (%) | AgI content (%) |
|---|---|---|---|---|---|
| F | Tabular grains having AAR of 5.0 | 0.25 | 85 | 25 | 4.0 |
| G | Tabular grains having AAR of 8.0 | 0.33 | 99 | 15 | 3.2 |
| H | Tabular grains having AAR of 10 | 0.88 | 99 | 8 | 2.8 |
| I | Tabular grains having AAR of 5.0 | 0.27 | 80 | 20 | 4.6 |
| J | Tabular grains having AAR of 8.0 | 0.45 | 98 | 15 | 4.6 |
| K | Tabular grains having AAR of 8.0 | 0.45 | 98 | 8 | 2.0 |
| L | Tabular grains having AAR of 10 | 0.81 | 99 | 8 | 1.0 |

Note
[1)]AAR signifies average aspect ratio.

TABLE 5

Spectral sensitization of emulsions

| Emulsion | Added sensitizing dye | Addition amount of the sensitizing dye per mol of silver halide (g) | Time at which the sensitizing dye is added |
|---|---|---|---|
| A | S-1 | 0.025 | During grain formation |
| | S-3 | 0.40 | |
| | S-2 | 0.01 | |
| B | S-1 | 0.01 | During grain formation |
| | S-3 | 0.40 | |
| C | S-1 | 0.01 | Before chemical sensitization |
| | S-3 | 0.30 | |
| | S-2 | 0.10 | |
| D | S-1 | 0.014 | Before chemical sensitization |
| | S-3 | 0.38 | |
| E | S-4 | 0.5 | Immediately after grain formation |
| | S-6 | 0.1 | |
| F | S-4 | 0.40 | Immediately after grain formation |
| | S-6 | 0.1 | |
| G | S-4 | 0.30 | Before chemical sensitization |
| | S-5 | 0.08 | |
| | S-6 | 0.05 | |
| H | S-4 | 0.25 | Before chemical sensitization |
| | S-5 | 0.06 | |
| | S-6 | 0.05 | |
| I | S-7 | 0.07 | Immediately after grain formation |
| | S-8 | 0.45 | |
| J | S-7 | 0.05 | Immediately after grain formation |
| | S-8 | 0.30 | |
| K | S-7 | 0.05 | Before chemical sensitization |
| | S-8 | 0.25 | |
| L | S-7 | 0.04 | Before chemical sensitization |
| | S-8 | 0.20 | |

(Preparation methods of emulsions)

A preparation method of the emulsion D will be described in detail below as one preparation method of these emulsions. The emulsions A to C and E to L were prepared by appropriately changing the following preparation method in accordance with conventional methods.

Preparation Method of Emulsion D

A 0.5 M silver nitrate solution and 120 cc of a 0.5 M potassium bromide solution were added over 60 sec by a double-jet method to 0.75 L of a 0.8% low-molecular-weight gelatin solution (molecular weight=10,000) containing 0.025 mol of potassium bromide while the solution was kept stirred at 40° C. thereby performing nucleation. During the addition, the pH of the gelatin solution was 5.0.

After the nucleation, the potential was so adjusted that the pBr was 2.1 by using KBr, and the temperature was raised to 75° C. 220 cc of a 10% deionized phthalated bone gelatin solution were added, and the emulsion was ripened for 10 min.

Thereafter, 150 g of silver nitrate and a solution of potassium iodide and potassium bromide were added over 60 min in accordance with a controlled double-jet method which was so controlled that the flow rate at the end was 19 times the flow rate at the beginning. Grains were grown while the potential during the addition was kept at −35 mV. After the addition, the temperature was lowered to 50° C., and the pBr was adjusted to 1.5 by using potassium bromide. Thereafter, 353 cc of a 1% potassium iodide solution were added. Furthermore, 327 cc of a 0.5 M silver nitrate solution and a 0.5 M potassium bromide solution were added at a potential of −30 mV by a controlled double-jet method, thereby forming shells. Subsequently, the resultant emulsion was washed with water at 35° C. by a well-known flocculation method, and gelatin was added to disperse the emulsion.

Sensitizing dyes S-1 and S-3 were added in amounts shown in Table 5 to the emulsion thus prepared, and the resultant emulsion was optimally chemically sensitized by using sodium benzenethiosulfonate, sodium thiosulfate, sodium thiocyanate, and chloroauric acid. Furthermore, compounds A-1 (to be presented below) and F-1 (represented above) were added to prepare a tabular AgBrI (AgI=2.0 mol %) emulsion D having a variation coefficient of a projected area equivalent circle diameter of 17%, an equivalent circle diameter of 0.94 μm, and an average thickness of 0.13 μm.

A-1

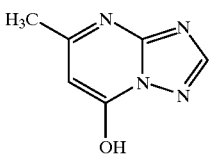

Samples 202 to 213 were prepared by replacing the green-sensitive low-speed emulsions E and F in the ninth layer used in the formation of the sample 201 with equal silver amounts of Em-1 to Em-12.

Evaluation of Samples (a) Evaluation of Sensitivity and Fog

The formed samples 201 to 213 were wedge-exposed at 2000 lux for 1/50 sec by using a white light source at a color temperature of 4800 K and developed as follows. Thereafter, the sensitivity was measured as a relative value of a reciprocal of a relative exposure amount (E) by which a magenta density of 0.2 was given by a G filter. Table 6 shows the relative values with respect to a standard value of 100 of the sample 201. Note that the sensitivity at which the magenta density is 0.2 is primarily brought about by a green-sensitive low-speed emulsion and a decrease in the magenta maximum density can be estimated as the fog of the green-sensitive emulsion.

(b) RMS Granularity

The RMS granularity at a magenta density of 0.2 was measured and represented by a relative value with respect to a value of 100 of the sample 201. The smaller the numerical value, the higher the granularity. These grains were made adsorb sensitizing dyes, so it is considered that spectral absorption was in proportion to the surface area of a grain. Therefore, an essential grain size calculated with the final number of grains was estimated by the ratio of the three-quarter power of the RMS granularity, and the value was converted assuming that its logarithm was equivalent to the sensitivity expressed in logE. The total performance also including the graininess was estimated from the sum of the sensitivity and the sensitivity that is converted from the granularity. Table 6 also shows these results.

Although the two emulsions E and F were replaced with each single one of various types of emulsions, the emulsions of the present invention was superior to the performance of the sample 201 in graininess. Emulsions having high aspect ratios of the present invention were particularly effective, and it was found that the use of the emulsions of the present invention was particularly effective when dislocation lines were introduced or an epitaxial portion primarily made from silver chloride was formed.

TABLE 6

| Coated sample | Emulsion used in 9th layer | Maximum value of magenta density | Sensitivity at which magenta density is 0.2 (log E) (A) | RMS granularity at which magenta density is 0.2 | Sensitivity estimated from the granularity (log E) (B) | Total performance of sensitivity and granularity (A) + (B) | |
|---|---|---|---|---|---|---|---|
| 201 | F,E | 3.29 | 0 (control) | 100 (control) | 0 (control) | 0 | Comp. |
| 202 | Em-1 | 3.28 | 0.10 | 113.1 | −0.07 | 0.03 | Comp. |
| 203 | Em-2 | 3.28 | 0.13 | 129.5 | −0.15 | −0.02 | Comp. |
| 204 | Em-3 | 3.32 | 0.07 | 73.4 | 0.18 | 0.22 | Inv. |
| 205 | Em-4 | 3.32 | 0.09 | 77.2 | 0.15 | 0.24 | Inv. |
| 206 | Em-5 | 3.33 | 0.16 | 84.0 | 0.10 | 0.26 | Inv. |
| 207 | Em-6 | 3.32 | 0.13 | 81.3 | 0.12 | 0.25 | Inv. |
| 208 | Em-7 | 3.33 | 0.21 | 83.9 | 0.10 | 0.31 | Inv. |
| 209 | Em-8 | 3.35 | 0.20 | 84.0 | 0.10 | 0.30 | Inv. |
| 210 | Em-9 | 3.35 | 0.23 | 85.5 | 0.09 | 0.32 | Inv. |
| 211 | Em-10 | 3.34 | 0.21 | 81.2 | 0.12 | 0.33 | Inv. |
| 212 | Em-11 | 3.31 | 0.20 | 115.0 | −0.08 | 0.12 | Comp. |
| 213 | Em-12 | 3.29 | 0.19 | 130.0 | −0.15 | 0.04 | Comp. |

(Processing steps and processing solutions in standard development)

| Step | Time | Temperature | Tank volume | Quantity of replenisher |
|---|---|---|---|---|
| 1st development | 6 min. | 38° C. | 12 L | 2200 mL/m$^2$ |
| Washing | 2 min. | 38° C. | 4 L | 7500 mL/m$^2$ |
| Reversal | 2 min. | 38° C. | 4 L | 1100 mL/m$^2$ |
| Color development | 6 min. | 38° C. | 12 L | 2200 mL/m$^2$ |
| Pre-bleaching | 2 min. | 38° C. | 4 L | 1100 mL/m$^2$ |
| Bleaching | 6 min. | 38° C. | 12 L | 220 mL/m$^2$ |
| Fixing | 4 min. | 38° C. | 8 L | 1100 mL/m$^2$ |
| Washing | 4 min. | 38° C. | 8 L | 7500 mL/m$^2$ |
| Final rinsing | 1 min. | 25° C. | 2 L | 1100 mL/m$^2$ |

The compositions of the processing solutions were as follows.

| 1st developing solution | Tank solution | Replenisher |
|---|---|---|
| Nitrilo-N,N,N-trimethylenephosphonic acid.pentasodium salt | 1.5 g | 1.5 g |
| Diethylenetriaminepentaacetic acid. pentasodium salt | 2.0 g | 2.0 g |
| Sodium sulfite | 30 g | 30 g |
| Hydroquinone.potassium monosulfonate | 20 g | 20 g |
| Potassium carbonate | 15 g | 20 g |
| Sodium bicarbonate | 12 g | 15 g |
| 1-phenyl-4-methyl-4-hydroxymethyl-3-pyrazolidone | 1.5 g | 2.0 g |
| Potassium bromide | 2.5 g | 1.4 g |
| Potassium thiocyanate | 1.2 g | 1.2 g |
| Potassium iodide | 2.0 mg | — |
| Diethyleneglycol | 13 g | 15 g |
| Water to make | 1000 mL | 1000 mL |
| pH | 9.60 | 9.60 |

The pH was controlled by sulfuric acid or potassium hydroxide.

| (Reversal solution) | Tank solution | Replenisher |
|---|---|---|
| Nitrilo-N,N,N-trimethylenephosphonic acid.pentasodium salt | 3.0 g | the same as tank solution |
| Stannous chloride.dihydrate | 1.0 g | |
| p-aminophenol | 0.1 g | |
| Sodium hydroxide | 8 g | |
| Glacial acetic acid | 15 mL | |
| Water to make | 1000 mL | |
| pH | 6.0 | |

The pH was controlled by acetic acid or sodium hydroxide.

| (Color developing solution) | Tank solution | Replenisher |
|---|---|---|
| Nitrilo-N,N,N-trimethylenephosphonic acid.pentasodium salt | 2.0 g | 2.0 g |
| Sodium sulfite | 7.0 g | 7.0 g |
| Trisodium phosphate.dodecahydrate | 36 g | 36 g |
| Potassium bromide | 1.0 g | — |
| Potassium iodide | 90 mg | — |
| Sodium hydroxide | 3.0 g | 3.0 g |
| Citrazinic acid | 1.5 g | 1.5 g |
| N-ethyl-N-(β-methanesulfonamidoethyl)-3-methyl-4 aminoaniline.3/2 sulfuric acid.monohydrate | 11 g | 11 g |
| 3,6-dithiaoctane-1,8-diol | 1.0 g | 1.0 g |
| Water to make | 1000 mL | 1000 mL |
| pH | 11.80 | 12.00 |

The pH was controlled by sulfuric acid or potassium hydroxide.

| (Pre-bleaching solution) | Tank solution | Replenisher |
|---|---|---|
| Ethylenediaminetetraacetic acid.disodium salt.dihydrate | 8.0 g | 8.0 g |
| Sodium sulfite | 6.0 g | 8.0 g |
| 1-thioglycerol | 0.4 g | 0.4 g |
| Formaldehyde sodium bisulfite adduct | 30 g | 35 g |
| Water to make | 1000 mL | 1000 mL |
| pH | 6.3 | 6.10 |

The pH was controlled by acetic acid or sodium hydroxide.

| (Bleaching solution) | Tank solution | Replenisher |
|---|---|---|
| Ethylenediaminetetraacetic acid.disodium salt.dihydrate | 2.0 g | 4.0 g |
| Ethylenediaminetetraacetic acid.Fe(III). ammonium.dihydrate | 120 g | 240 g |
| Potassium bromide | 100 g | 200 g |
| Ammonium nitrate | 10 g | 20 g |
| Water to make | 1000 mL | 1000 mL |
| pH | 5.70 | 5.50 |

The pH was controlled by nitric acid or sodium hydroxide.

| (Fixing solution) | Tank solution | Replenisher |
|---|---|---|
| Ammonium thiosulfate | 80 g | the same as tank solution |
| Sodium sulfite | 5.0 g | |
| Sodium bisulfite | 5.0 g | |
| Water to make | 1000 mL | |
| pH | 6.60 | |

The pH was controlled by acetic acid or ammonia water.

| (Final rinsing solution) | Tank solution | Replenisher |
|---|---|---|
| 1,2-benzoisothiazoline-3-one | 0.02 g | 0.03 g |
| Polyoxyethylene-p-monononylphenylether (average polymerization degree = 10) | 0.3 g | 0.3 g |
| Polymaleic acid (average molecular weight = 2,000 | 0.1 g | 0.15 g |
| Water to make | 1000 mL | 1000 mL |
| pH | 7.0 7.0 | |

Example 3

Samples were prepared by replacing the emulsions of the red-sensitive layer of the sample 201 prepared in Example 2 with each of Em-1 to Em-12 of the invention following the similar procedures as in Example 2 and similarly evaluated. The effects of the present invention on the red-sensitive layers were checked, and results similar to those in Example 2 were obtained.

Example 4

Samples were prepared by replacing the emulsion of the blue-sensitive layer of the sample 201 in Example 2 with each of Em-1 to Em-12 of the invention following the similar procedures as in Example 2 and similarly evaluated. The effects of the present invention on the blue-sensitive layers were checked, and results similar to those in Example 2 were obtained.

The silver halide color photographic light-sensitive material of the present invention has higher sensitivity and higher graininess than those of conventional products.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A silver halide emulsion, wherein a sum of projected areas of tabular silver halide grains, in which an outer shell region that is 40% or less in volume from a grain surface contains 5 mol % to 20 mol % of iodide ions with respect to a silver halide in said outer shell region, and which have a projected area diameter of 0.08 μm to 0.5 μm and an aspect ratio of 2 to 30, accounts for not less than 80% of the total projected area of all grains.

2. The emulsion according to claim 1, wherein when each tabular silver halide grain is a host grain, at least one epitaxially grown portion containing not less than 10 mol % of silver chloride is further formed on said host grain.

3. The emulsion according to claim 2, wherein the amount of the epitaxially grown portion is 50 mol % or less of the silver amount of the host grain.

4. The emulsion according to claim 1, wherein one or both of an interior and a surface of said tabular silver halide grain have at least one reduction-sensitized region.

5. The emulsion according to claim 1, wherein either a surface of said tabular silver halide grain or both an interior and a surface of said tabular silver halide grain are subjected to selenium sensitization, tellurium sensitization, or selenium-tellurium sensitization.

6. The emulsion according to claim 1, wherein an interior of said tabular grain, a surface of said tabular grain, or both of an interior and a surface of said tabular silver halide grain are subjected to reduction sensitization and selenium sensitization, reduction sensitization and tellurium sensitization, or reduction sensitization and selenium-tellurium sensitization.

7. The emulsion according to claim 1, wherein an average grain thickness of said tabular silver halide grains is not more than 0.2 $\mu$m.

8. A silver halide photographic light-sensitive material containing the silver halide emulsion according to claim 1 in at least one layer thereof.

9. The emulsion according to claim 1, wherein the tabular silver halide grains have a projected area diameter of 0.08 $\mu$m to 0.4 $\mu$m.

10. The emulsion according to claim 1, wherein the tabular silver halide grains have an aspect ratio of 3 to 25.

11. The emulsion according to claim 1, wherein the outer shell region is 20% or less in volume from the grain surface and contains 7 mol % to 15 mol % of iodide ions with respect to a silver halide in the outer shell region.

12. The emulsion according to claim 1, which contains at least one selenium sensitizer selected from the group consisting of triphenylphosphineselenide, diphenyl (pentafluorophenyl)phosphineselenide, tri-p-tolylselenophosphate, selenophosphinic acid esters, selenophophonic acid esters, N,N-dimethylselenourea, N-acetyl-N,N',N'-trimethylselenourea, N-trifluoroacetyl-N,N',N'-trimethylselenourea, N,N-dimethylselenobenzamide, N,N-diethylselenobenzamide, p-methoxyselenobenzoic acid o-isopropyl ester, p-methoxyselenobenzoic acid Se-(3'oxocyclohexyl)ester, bis(2,6-dimethoxybenzoyl)selenide, bis(2,4-dimethoxybenzoyl)selenide, bis(N,N-dimethylcarbamoyl)selenide, bis(butoxycarbonyl)selenide, bis(benzyloxycarbonyl)selenide, 2,4,6-tris(p-methoxyphenyl)triselenane, diselenides, polyselenides, selenium sulfide, selenoketones, selenecarboxylic acids, sodium selenite, potassium selenocyanate isoselnocyanates and colloidal selenium.

13. The emulsion according to claim 12, wherein the selenium sensitizer is present in an amount of from $1\times10^{-4}$ to $1\times10^{-7}$ mole per mole of the silver halide in the emulsion.

14. The emulsion according to claim 12, wherein the reduction sensitizer is present in an amount of from $10^{-7}$ to $10^{-3}$ mole per mole of the silver halide in the emulsion.

15. The emulsion according to claim 1, which contains at least one tellurium sensitizer selected from the group consisting of n-butyldiissopropylphosphinetelluride, triisobutylphosphinetelluride, tri-n-butoxyphosphinetelluride, triisopropylphosphinetelluride, bis(diphenylcarbamoyl)ditelluride, bis(N-phenyl-N-methylcarbamoyl)ditelluride, bis(N-phenyl-N-methylcarbamoyl)telluride, bis(N-phenyl-N-benzylcarbamoyl)telluride, bis(ethyoxycarbonyl)telluride, N,N'-dimethylethylenetellurourea, telluroamides and telluroesters.

16. The emulsion according to claim 15, wherein the tellurium sensitizer is present in an amount of from $1\times10^{-4}$ to $1\times10^{-7}$ mole per mole of the silver halide in the emulsion.

17. The emulsion according to claim 1, which contains at least one reduction sensitizer selected from the group consisting of stannous chloride, thiourea dioxide, ascorbic acid and its derivatives, amines, polyamines, hydrazine derivatives, formadinesulfinic acid, silane compounds, borane compounds, and dimethylamineborane.

18. The emulsion according to claim 1, which contains a gold sensitizer present in an amount from $1\times10^{-4}$ to $1\times10^{-7}$ mole per mole of the silver halide.

19. The emulsion according to claim 1, which contains a hydrophilic colloid selected from the group consisting of gelatin, a graft polymer of gelatin and another high polymer, albumin, casein, hydroxyethylcelluose, carboxymethylcellulose, cellulose sulfate, soda alginate, starch derivative, polyvinyl alcohol, polyvinyl alcohol partial acetal, poly-N-vinylpyrrolidone, polyacrylic acid, polymethacrylic acid, polyacrylamide, polyvinylimidazole and polyvinylpyrazole.

* * * * *